US009576533B2

(12) United States Patent
Kumeta et al.

(10) Patent No.: US 9,576,533 B2
(45) Date of Patent: Feb. 21, 2017

(54) DISPLAY APPARATUS AND CONTROLLING METHOD THEREOF

(71) Applicant: SAMSUNG DISPLAY CO., LTD., Yongin, Gyeonggi-Do (KR)

(72) Inventors: Masayuki Kumeta, Yokohama (JP); Ryo Ishii, Yokohama (JP); Eiji Kanda, Yokohama (JP); Naoaki Komiya, Yokohama (JP)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 64 days.

(21) Appl. No.: 14/626,568

(22) Filed: Feb. 19, 2015

(65) Prior Publication Data

US 2015/0243226 A1 Aug. 27, 2015

(30) Foreign Application Priority Data

Feb. 21, 2014 (JP) ..... 2014-031673

(51) Int. Cl.
*G09G 3/3233* (2016.01)
*G09G 3/32* (2016.01)

(52) U.S. Cl.
CPC ..... *G09G 3/3233* (2013.01); *G09G 2360/147* (2013.01)

(58) Field of Classification Search
CPC ..... G09G 3/3233; G09G 2320/0295; G09G 2320/043; G09G 2320/0233
USPC ..... 345/76, 82, 77; 315/169.3
See application file for complete search history.

(56) References Cited

U.S. PATENT DOCUMENTS

| | | | | |
|---|---|---|---|---|
| 8,139,007 | B2 | 3/2012 | Mizutani et al. | |
| 2009/0027377 | A1* | 1/2009 | Kwon | G09G 3/3233 345/214 |
| 2011/0018858 | A1* | 1/2011 | Ryu | G09G 3/3233 345/213 |
| 2011/0164010 | A1 | 7/2011 | Yamamoto et al. | |
| 2013/0147693 | A1* | 6/2013 | Bae | G09G 3/3208 345/82 |
| 2015/0170578 | A1* | 6/2015 | Choi | G09G 3/3266 345/212 |

FOREIGN PATENT DOCUMENTS

| | | | |
|---|---|---|---|
| EP | 1 517 290 | A2 | 3/2005 |
| JP | 2006-215213 | A | 8/2006 |
| JP | 2009-244654 | A | 10/2009 |
| JP | 4593868 | B2 | 9/2010 |
| JP | 4798342 | B2 | 8/2011 |
| JP | 2012-022329 | A | 2/2012 |

* cited by examiner

*Primary Examiner* — Koosha Sharifi-Tafreshi
(74) *Attorney, Agent, or Firm* — Lee & Morse, P.C.

(57) ABSTRACT

A display apparatus includes a display unit, a control unit, and a compensation unit. The compensation unit may compensate the display data when a sensing operation is performed on a target pixel circuit, the compensation unit compensating display data by setting a light emission amount of light emitting element of a target pixel circuit to be an amount obtained by subtracting a sensing light emission amount, which is a light emission amount of the light emitting element of the target pixel circuit during a sensing interval, from a display light emission amount, which is a light emission amount of the light emitting element of the target pixel circuit before the compensation.

6 Claims, 23 Drawing Sheets

DISPLAY APPARATUS AND CONTROLLING METHOD THEREOF

CROSS-REFERENCE TO RELATED APPLICATIONS

Japanese Patent Application No. 2014-031673, filed on Feb. 21, 2014, in the Japanese Patent Office, and entitled: "Display Apparatus and Controlling Method Thereof," is incorporated by reference herein in its entirety.

BACKGROUND

1. Field

Embodiments relate to a display apparatus and a method for controlling the same.

2. Description of the Related Art

In a display apparatus, the quality of an image may vary if voltage-current (VI) characteristics of a light emitting element forming the image vary. Accordingly, control of image variation is desirable.

SUMMARY

Embodiments are directed to a display apparatus, including a display unit including a plurality of pixel circuits, each of which includes a light emitting element, the display unit displaying an image corresponding to a data signal supplied on a basis of display data; a control unit to control, for each pixel circuit, light emission of the light emitting element at a display interval, during which the image is displayed, and sensing of the light emitting element at a sensing interval, during which the light emitting element is sensed using a sensing operation; and a compensation unit to compensate the display data when the sensing operation is performed on a target pixel circuit, the compensation unit compensating the display data by setting a light emission amount of the light emitting element of the target pixel circuit to be an amount obtained by subtracting a sensing light emission amount, which is a light emission amount of the light emitting element of the target pixel circuit during the sensing interval, from a display light emission amount, which is a light emission amount of the light emitting element of the target pixel circuit before the compensation.

The display unit may emit light during vertical intervals that each include the display interval and the sensing interval, and, when the display data of a vertical interval that corresponds to the target pixel circuit is identical to the display data of a vertical interval that corresponds to a non-target pixel circuit, for which the sensing operation is not performed, the compensation unit may compensate the display data so that the light emission amount of the light emitting element of the target pixel circuit is equal to the light emission amount of the light emitting element of the non-target pixel circuit.

The control unit may selectively perform the sensing operation on the target pixel circuit on the basis of the display data.

The control unit may not perform the sensing operation on the target pixel circuit in a case where the display light emission amount is smaller than the sensing light emission amount, or the display light emission amount is equal to or smaller than the sensing light emission amount.

The display unit may emit light during a vertical interval, the display interval and the sensing interval being included in the vertical interval, the display interval may include a plurality of sub-fields used in combination to emit light corresponding to the display data, the sensing interval may include an emission interval during which the light emitting element of the target pixel circuit selectively emits light according to the sensing operation, and the sensing light emission amount may be substantially equal to a light emission amount of a preselected one of the sub-fields, the control unit may perform the sensing operation on the target pixel when the display data for the target pixel has a value that uses the preselected sub-field, and the control unit may not perform the sensing operation on the target pixel when the display data for the target pixel does not use the preselected sub-field.

Embodiments are also directed to a method for controlling a display apparatus that includes a display unit including a plurality of pixel circuits, each of which includes a light emitting element, the display unit displaying an image corresponding to a data signal supplied on a basis of display data, the method including controlling, for each pixel circuit, light emission of the light emitting element at a display interval, during which the image is displayed, and sensing of the light emitting element at a sensing interval, during which the light emitting element is sensed using a sensing operation; and compensating the display data, wherein, when the sensing operation is performed on a target pixel circuit, the compensating of the display data includes setting a light emission amount of the light emitting element of the target pixel circuit to be a light emission amount obtained by subtracting a sensing light emission amount, which is a light emission amount of the light emitting element of the target pixel circuit during the sensing interval, from a display light emission amount, which is a light emission amount of the light emitting element of the target pixel circuit before the compensation.

BRIEF DESCRIPTION OF THE DRAWINGS

Features will become apparent to those of skill in the art by describing in detail example embodiments with reference to the attached drawings in which.

DETAILED DESCRIPTION

Figure 1:
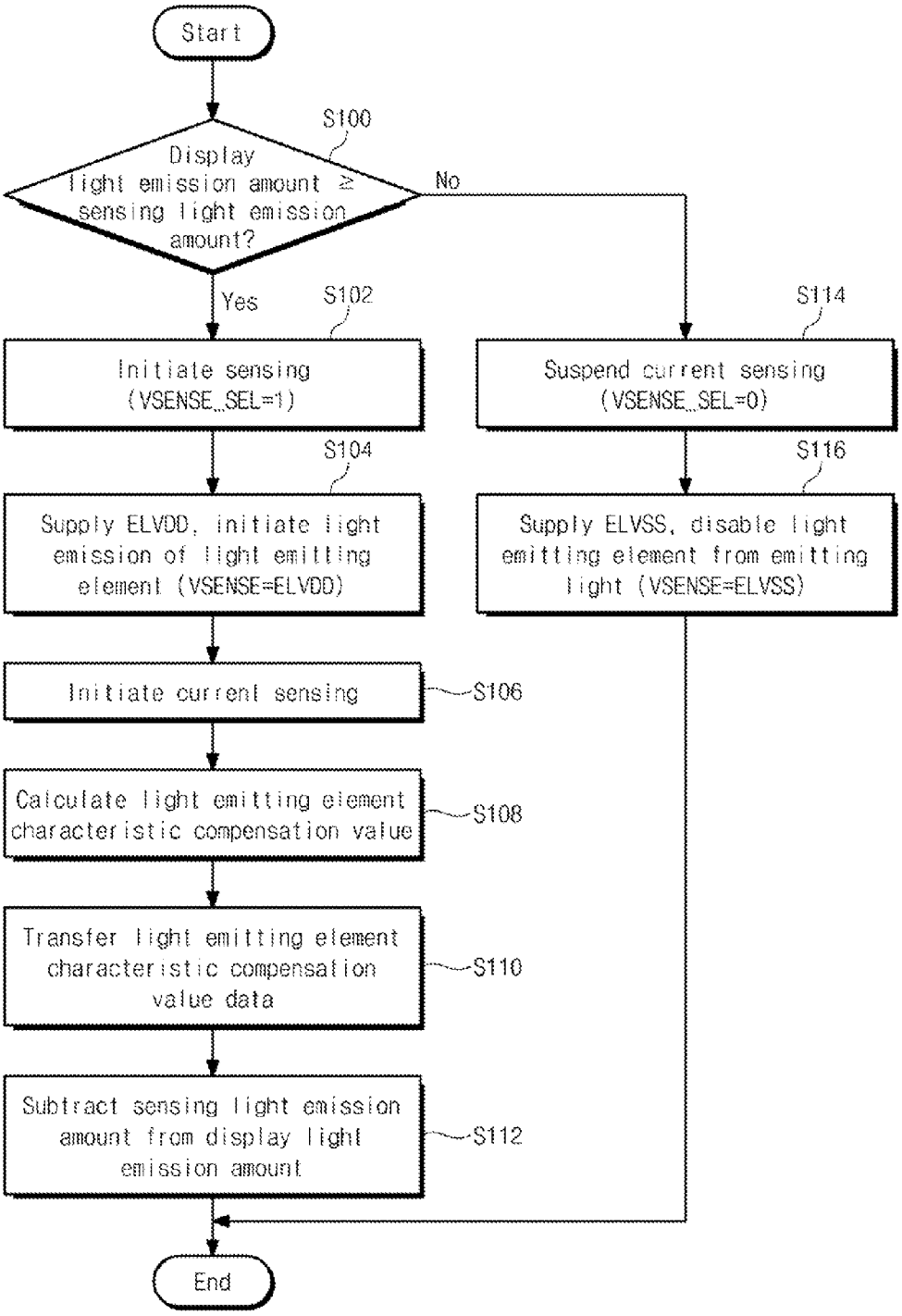
FIG. 1 is a flowchart of a method for controlling a display apparatus according to an example embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey example implementations to those skilled in the art. In the drawing figures, the dimensions of layers and regions may be exaggerated for clarity of illustration. Like reference numerals refer to like elements throughout.

Hereinafter is provided an outline of a display apparatus and a method for controlling the same according to an example embodiment.

A display apparatus according to an example embodiment is an active-matrix-type display apparatus having a pixel circuit with a light emitting element.

A light emitting element according to an example embodiment may be an organic electroluminescence (EL) element or an inorganic EL element. Hereinafter, a light emitting element will be described as an organic EL element in an example embodiment.

In the case where an active-matrix-type display apparatus displays an image by virtue of a constant voltage and digital driving, a current that flows through a light emitting element may vary even if a constant voltage is applied thereto due to a change in VI characteristics of the light emitting element. As a result, the quality of an image may degrade due to luminance unevenness.

Changes in the VI characteristics and IL (current-inductor) characteristics of a light emitting element may be caused by, e.g., variation in a manufacturing process of the light emitting element or a change in time dependent degradation (degradation as time passes) of the light emitting element. Due to a change in the VI characteristics caused by the variation in the manufacturing process of the light emitting element, the luminance unevenness may occur in a display apparatus. Furthermore, due to a change in the IL characteristics caused by the time dependent degradation of the light emitting element, an image sticking phenomenon may occur in a display apparatus.

U.S. Pat. No. 8,139,007 is incorporated by reference herein for all purposes. The VI characteristics of a light emitting element may be sensed using the technology of U.S. Pat. No. 8,139,007 for measuring the VI characteristics of a light emitting element, and the VI characteristics of the light emitting element may be compensated on the basis of a result of the sensing. In this case, degradation of the image quality may be mitigated or prevented.

U.S. Pat. No. 8,139,007 discloses that a plurality of constant-current circuits supply a predetermined test current to a plurality of data lines. The test current is provided to a light emitting element of each pixel. When the test current flows through the light emitting element, a voltage between terminals of the light emitting element is measured so that the VI characteristics of the light emitting elements are measured.

However, according to the technology disclosed in U.S. Pat. No. 8,139,007, the test current is provided to the light emitting elements when the VI characteristics of the light emitting elements are measured. Therefore, the light emitting element emits light when the VI characteristics of the light emitting elements are measured, which may cause contrast degradation due to a misadjusted black level or a line defect. As a result, the quality of an image may degrade.

The display apparatus according to an example embodiment controls, for each pixel circuit, light emission of a light emitting element due to display of an image and a sensing operation on the light emitting element at an interval for displaying an image (referred to herein as a display interval) and an interval for performing the sensing operation on a light emitting element (referred to herein as a sensing interval).

According to an example embodiment, one vertical interval includes the display interval and the sensing interval. At each vertical interval, light emission of a light emitting element due to display of an image and the sensing operation on the light emitting element are controlled for each pixel circuit.

The display apparatus according to an example embodiment compensates display data corresponding to an image displayed on a display unit, in the case where the sensing operation is performed on a pixel circuit subject to the sensing operation (referred to herein as a target pixel circuit). For example, the display data corresponding to the target pixel circuit may be compensated by subtracting a light emission amount of the light emitting element of the target pixel circuit which emits light at the sensing interval from the display data.

Therefore, the light emission amount of the light emitting element of the target pixel circuit of one vertical interval, which corresponds to the display data that has been compensated, has a value obtained by subtracting the light emission amount of the target pixel circuit at the sensing interval from the light emission amount of the light emitting element of the target pixel circuit of one vertical interval which corresponds to the display data that has not been compensated.

At one vertical interval, the light emission amount of the light emitting element of the target pixel circuit, which corresponds to the display data that has not been compensated, is referred to as a display light emission amount. At the sensing interval, the light emission amount of the light emitting element of the target pixel circuit is referred to as a sensing light emission amount.

Since the display data is compensated as described above, in the case where, at one arbitrary vertical interval (one frame interval), the display data of one vertical interval which corresponds to the target pixel circuit is identical to the display data of one vertical interval which corresponds to a pixel circuit that has not undergone the sensing operation (referred to herein as a non-target pixel circuit), the light emission amount of the target pixel circuit is equal to the light emission amount of the non-target pixel circuit.

Therefore, since the display apparatus according to an example embodiment compensates the display data as described above, the display data may be matched to the light emission amount at one vertical interval even if the sensing operation is performed. As a result, the display apparatus according to an example embodiment may mitigate or prevent the degradation of the image quality which may occur due to light emission of the light emitting element during the sensing operation.

FIG. 1 is a flowchart illustrating a method for controlling a display apparatus according to an example embodiment.

Referring to FIG. 1, in operation S100, it is determined whether or not the display light emission amount is equal to or larger than the sensing light emission amount. The light emission amount of a light emitting element of a pixel corresponds to the luminance and is determined by multiplication between a current i that flows through the light emitting element and a light emission time t.

The display light emission amount is determined on the basis of the display data, and the sensing light emission amount is determined on the basis of the sensing interval. Thus, in operation S100, a result of determination is obtained on the basis of the display data corresponding to the target pixel circuit.

According to the method for controlling the display apparatus according to an example embodiment, the display data is reduced by as much as the sensing light emission amount of the target pixel circuit, which may prevent the degradation of the image quality that may occur when the VI characteristics of a light emitting element are sensed.

In the case where the display data corresponds to the target pixel circuit presents black color, or the display data presents a low gradation, the display data may not be reduced by as much as the sensing light emission amount. Therefore, the determination of operation S100 is performed so as to determine whether to reduce the display data by as much as the sensing light emission amount.

If the condition of operation S100 is satisfied, i.e., if it is possible to reduce the display data by as much as the sensing light emission amount, the sensing operation may be performed on the target pixel circuit (operations S102 to S112 described below). If the condition of operation S100 is not satisfied, i.e., if it is not possible to reduce the display data by as much as the sensing light emission amount, the sensing operation may not be performed on the target pixel circuit (operations S114 and S116 described below). Thus, the sensing operation is selectively performed on the target pixel circuit on the basis of the display data.

Accordingly, the display apparatus according to an example embodiment may prevent the degradation of the image quality due to the misadjusted black level even if the display data is for presenting a low degradation.

The condition of operation S100 is not limited to that illustrated in FIG. 1. For example, it may be determined whether the display light emission amount is larger than the sensing light emission amount in operation S100. In this case, if it is determined that the display light emission amount is larger than the sensing light emission amount, the sensing operation is performed on the target pixel circuit.

If it is determined that the display light emission amount is equal to or larger than the sensing light emission amount in operation S100, the sensing operation is performed on the target pixel circuit in operation S102.

In operation S104, a voltage ELVDD is supplied to the target pixel circuit, and light emission of the light emitting element is initiated. The voltage ELVDD supplied to the target pixel circuit may be a voltage VSENSE according to sensing control (referred to herein as a sensing voltage), and may be a sensing voltage for measuring the VI characteristics of the light emitting element. The voltage ELVDD is supplied to the target pixel circuit from a first common power supply source. The first common power supply source may be provided to the display apparatus according to an example embodiment, or may be an external power supply source disposed outside the display apparatus.

Current sensing is initiated in operation S106. A configuration of the display apparatus for the current sensing will be described in detail below.

A light emitting element characteristic compensation value for compensating a characteristic of the light emitting element is calculated in operation S108. Light emitting element characteristic compensation value data that represents the light emitting element characteristic compensation value calculated in operation S108 is transferred to a recording medium such as a memory in operation S110.

In operation S112, the display data is compensated so that the light emission amount of the target pixel circuit has a value obtained by subtracting the sensing light emission amount from the display light emission amount.

For example, in the case where the display apparatus performs digital driving, the display data is compensated so that a light emission time for which the light emitting element emits light becomes shorter at the display interval, and the light emission amount of the target pixel circuit has thus the value obtained by subtracting the sensing light emission amount from the display light emission amount at one vertical interval.

In the case where the display apparatus performs analog driving, the display data is compensated so that a current that flows to the light emitting element becomes smaller at the display interval, and the light emission amount of the target pixel circuit has thus the value obtained by subtracting the sensing light emission amount from the display light emission amount at one vertical interval.

If it is determined that the display light emission amount is not equal to or larger than the sensing light emission amount in operation S100, the sensing operation on the pixel circuit is suspended in operation S114.

A voltage ELVSS is provided to the target pixel circuit to suspend the sensing operation, so that the light emitting element does not emit light in operation S116.

The voltage ELVSS provided to the target pixel circuit may be a sensing voltage VSENSE for disabling the light emitting element from emitting light. The voltage ELVSS is supplied to the target pixel circuit from a second common power supply source. The second common power supply source serves as a base power supply source. The second common power supply source may be provided to the display apparatus according to an example embodiment, or may be an external power supply source.

In this manner, when the sensing operation is performed, the display data is compensated with the light emission amount obtained by subtracting the sensing light emission amount from the display light emission amount, and the sensing operation is performed or suspended on the basis of a result of comparison between the display data (display light emission amount) and the sensing interval (sensing light emission amount).

Therefore, the degradation of the image quality due to a line defect which may occur since the light emitting element emits light when being sensed, or the degradation of the image quality which may occur when the VI characteristics of the light emitting element are sensed may be prevented.

Furthermore, the degradation of the image quality due to the misadjusted black level may be prevented even if the display data is for presenting a low degradation.

Figure 2A:
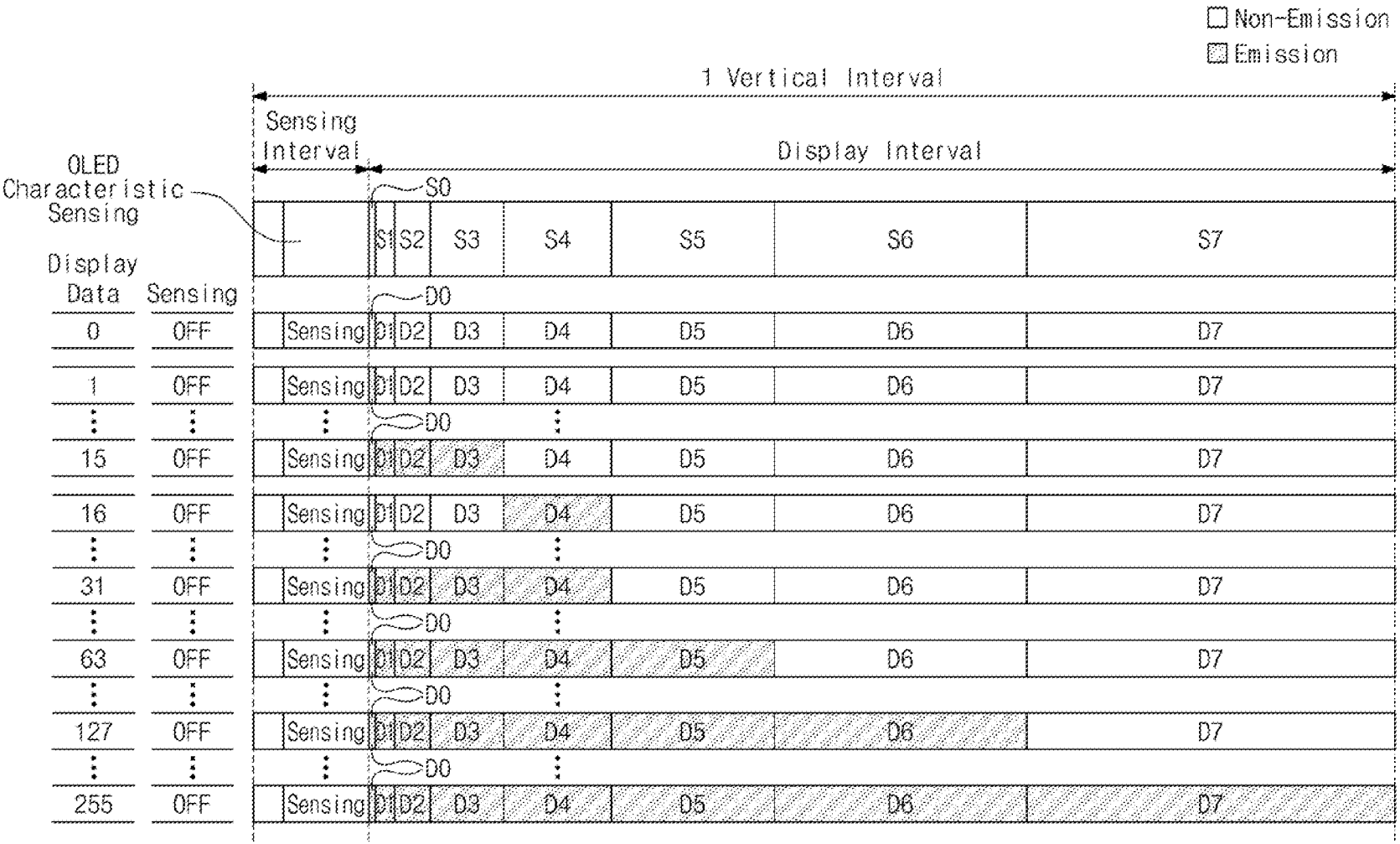
FIGS. 2A and 2B are diagrams exemplarily illustrating display data and a light emission state of a light emitting element of a pixel circuit in a display apparatus according to a first example embodiment.
Figure 2B:
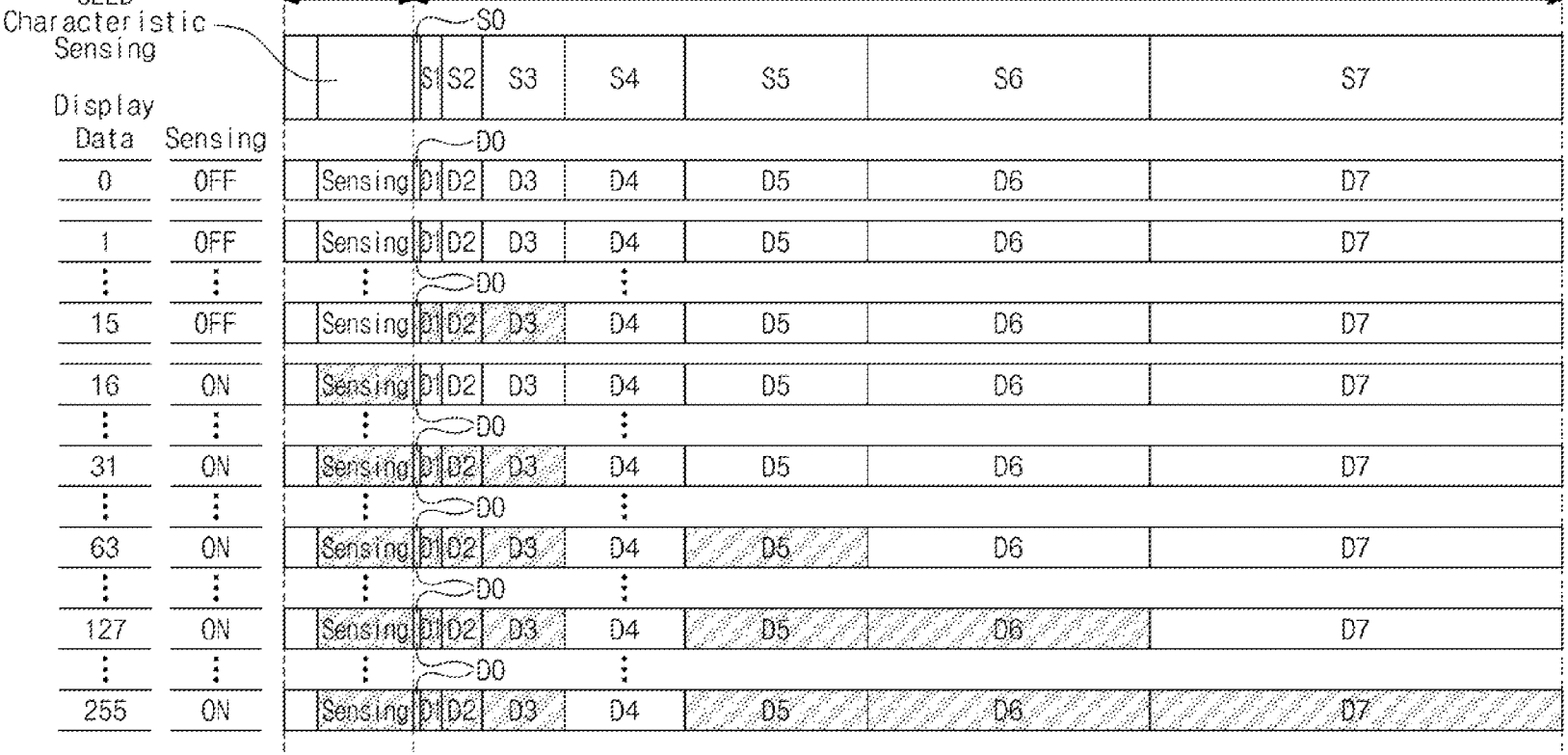

FIGS. 2A and 2B are diagrams exemplarily illustrating the display data and a light emission state of the light emitting element of the pixel circuit in the display apparatus according to a first example embodiment.

According to the present example embodiment, the display apparatus may perform simultaneous driving for presenting a gradation while turning on or off the light emitting element of a pixel at each interval of sub-fields obtained by dividing one field.

FIG. 2A is a diagram exemplarily illustrating the display data and the light emission state of the light emitting element in the non-target pixel circuit (sensing not performed during the sensing interval). FIG. 2B is a diagram exemplarily illustrating the display data and the light emission state of the light emitting element in the target pixel circuit (sensing performed during the sensing interval).

In FIGS. 2A and 2B, eight subfields are illustrated as an example (sub-fields D0, D1, D2, D3, D4, D5, D6, and D7), representing 256 gradations. In the illustrated example, the sensing light emission amount is set to be 16 gradations, i.e., substantially equal to the gradations of sub-field D4 ($2^4$).

In FIG. 2A, the non-target pixel circuit does not emit light at the sensing interval and emits light at the display interval.

In FIG. 2B, the target pixel circuit emits light at the sensing interval (sensing ON at display data values 16, etc.) and does not emit light at sub-field D4 of the display interval.

In the illustrated example, the sensing light emission amount is set to be 16 gradations, i.e., substantially equal to the gradations of sub-field D4. Thus, for the case where the sensing light emission amount is set to be 16 gradations, if the display data has a value that does not include the sub-field D4 (e.g., display data values of 0, 1, 15, etc.), sensing may be set to OFF as shown in FIG. 2A.

The operations of the non-target pixel circuit of FIG. 2A and the target pixel circuit of FIG. 2B are different from each other with respect to a light emission timing (i.e., when, within the vertical interval, light emission occurs), but are the same with respect to a light emission amount at one vertical interval (i.e., the amount of light emission in the vertical interval is substantially the same for corresponding display data values in FIGS. 2A and 2B). Thus, it may be understood from FIGS. 2A and 2B that the display data is matched to the light emission amount at one vertical interval.

FIGS. 2A and 2B exemplarily illustrate that one vertical interval includes one sensing interval, but one vertical interval may include a plurality of sensing intervals in an example embodiment. Furthermore, in the case of performing the simultaneous driving of FIGS. 2A and 2B, the sensing interval may occur at other places within the vertical interval, e.g., the sensing interval may be disposed between the sub-field intervals in an example embodiment.

Figure 3:
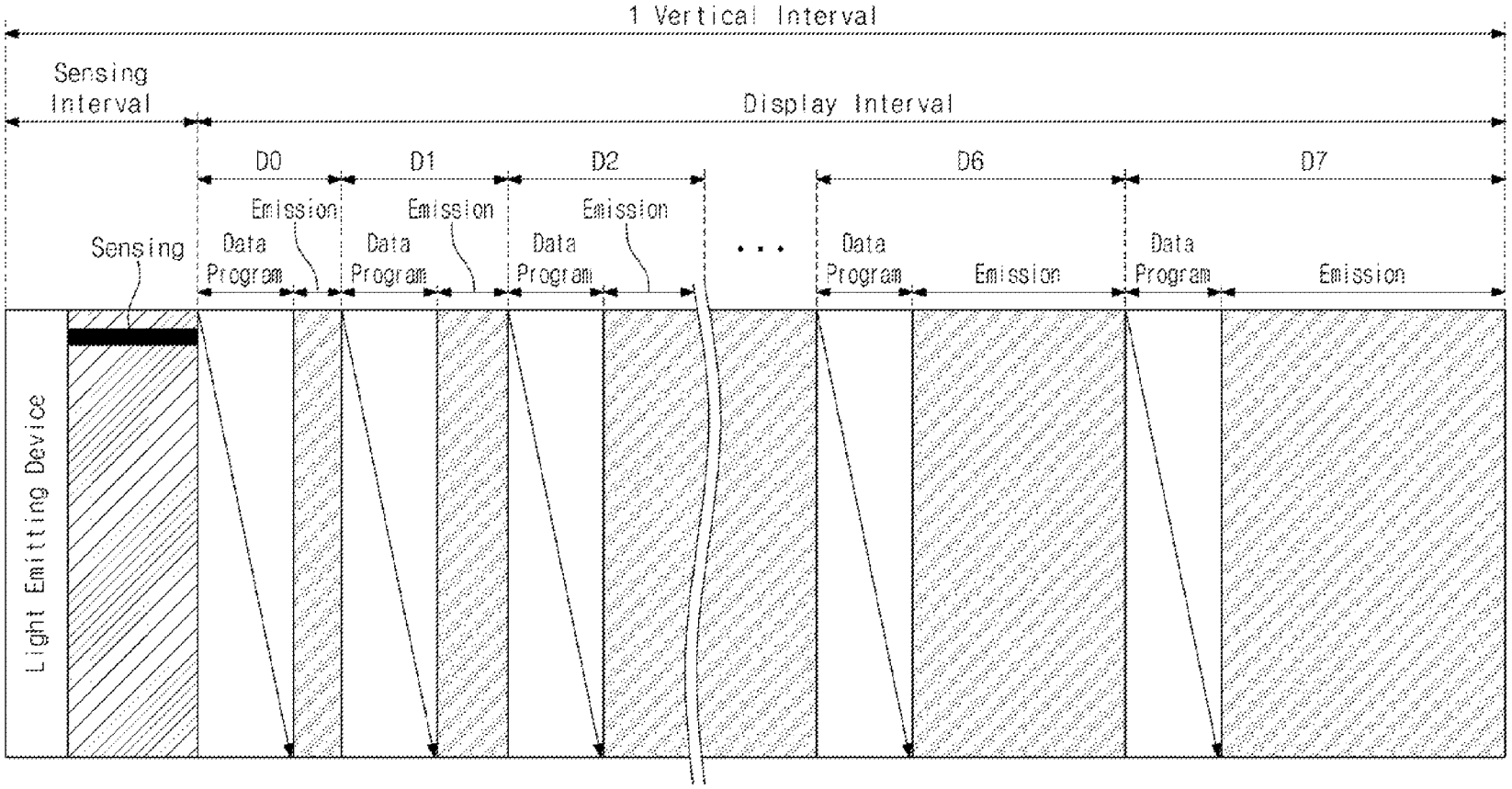
FIG. 3 is a timing chart exemplarily illustrating operation of the display apparatus according to the first example embodiment.

FIG. 3 is a timing chart exemplarily illustrating operation of the display apparatus according to the first example embodiment.

Referring to FIG. 3, one field includes a plurality of sub-field intervals, and, at each sub-field interval, the digital driving is performed to present a gradation by turning on or off the light emitting element of a pixel. D0 to D7 illustrated in FIG. 3 respectively correspond to the sub-fields.

Furthermore, as illustrated in FIG. 3, one vertical interval includes the sensing interval, for sensing the characteristics of the light emitting element of a pixel, and the display interval, for displaying an image on a display screen by controlling the light emission amount of the light emitting element of a pixel on the basis of the display data.

At the sensing interval, all the pixel circuits are programmed with off-data so that light emission of all the pixel circuits is suspended. Thereafter, a voltage is applied to the light emitting element of the target pixel circuit selected by a sensing selection signal so that the characteristics of the light emitting element of the target pixel circuit are sensed.

Each sub-field interval of the display interval includes a data program interval and a light emission interval. At the data program interval of the display interval, data update is performed in a line sequential manner. After data programming for all the pixel circuits is completed, light emission control of the display apparatus is performed at the light emission interval of the display interval.

Figure 4:
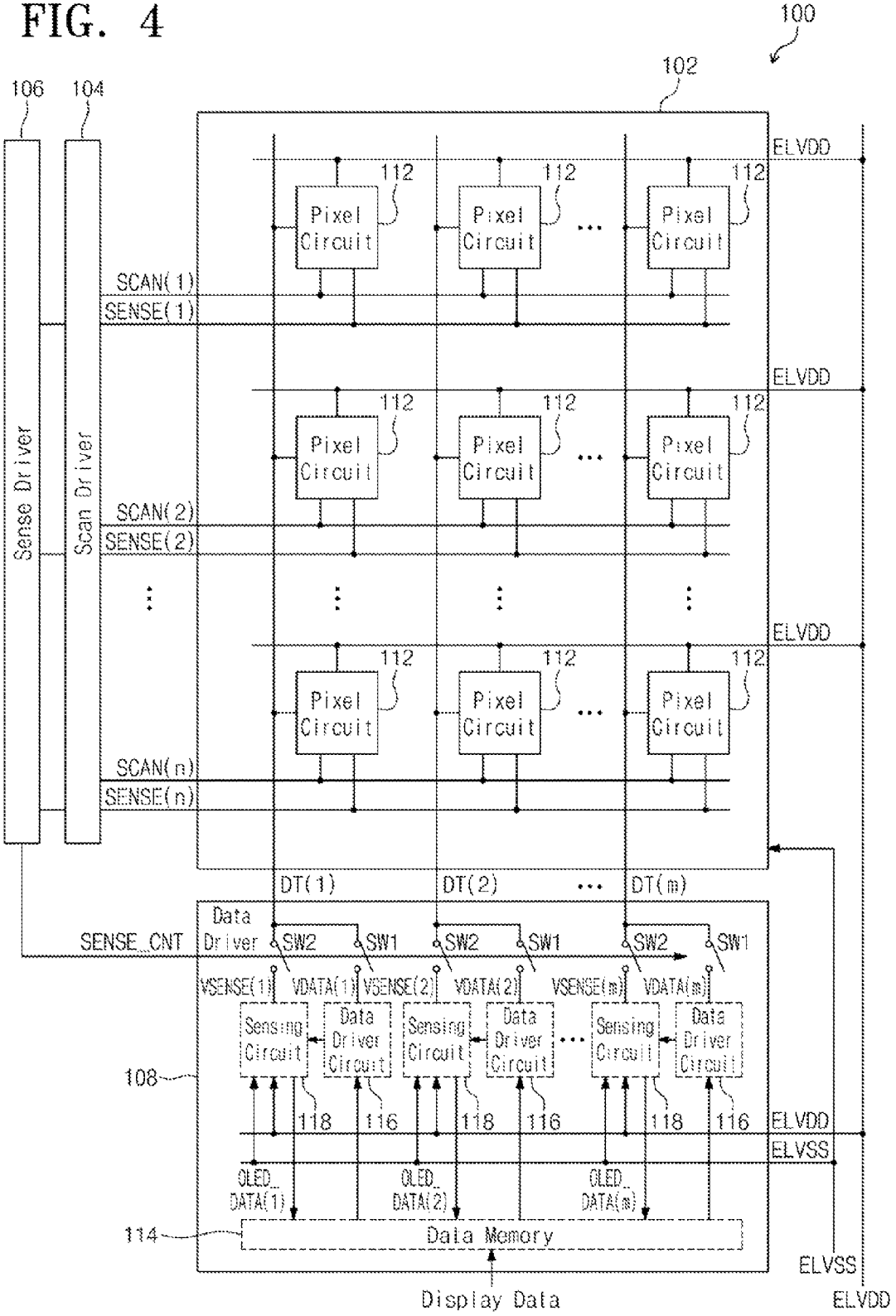
FIG. 4 is a diagram of a configuration of the display apparatus according to the first example embodiment.
Figure 5:
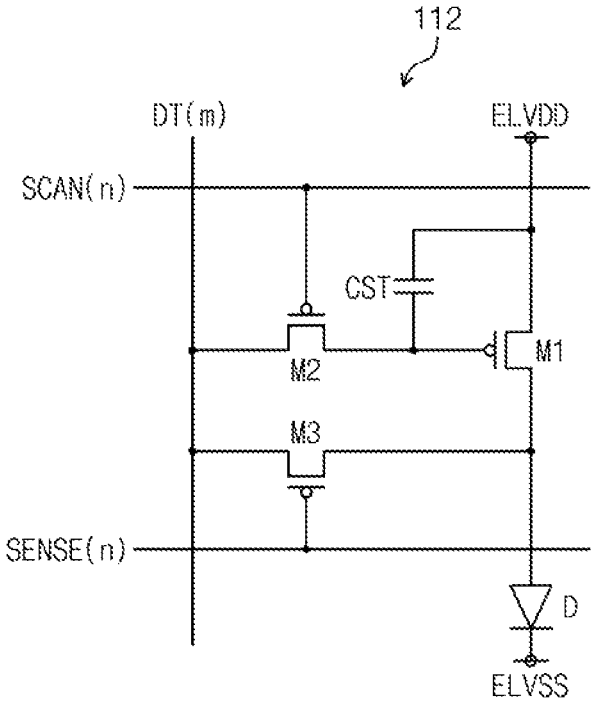
FIG. 5 is a diagram of a configuration of the pixel circuit illustrated in FIG. 4.

FIG. 4 is a diagram illustrating a configuration of the display apparatus according to the first example embodiment. FIG. 5 is a diagram illustrating a configuration of the pixel circuit illustrated in FIG. 4.

Referring to FIG. 4, a display apparatus 100 according to the first example embodiment includes a display unit 102, a scan driver 104, a sense driver 106, and a data driver 108.

The display unit 102 includes a plurality of pixel circuits 112 for displaying an image corresponding to data signals. The pixel circuits 112 are arranged in a matrix form so as to be connected to a plurality of control lines SCAN(1) to SCAN(n) and SENSE(1) to SENSE(n) extending in a row direction and a plurality of data lines DT(1) to DT(m) extending in a column direction. The pixel circuits may be arranged in an n×m matrix, where n and m are natural numbers.

The scan driver 104, the sense driver 106, and the data driver 108 serve as a control unit or a compensation unit for the display apparatus control method according to an example embodiment.

In detail, the scan driver 104, the sense driver 106, and the data driver 108 serve as the control unit for controlling light emission of the light emitting element due to display of an image and for controlling sensing on the light emitting element for each pixel circuit 112. Furthermore, the data driver 108 serves as the compensation unit for compensating the display data when the sensing operation is performed.

The control unit of the display apparatus 100 according to an example embodiment may include a timing controller for controlling operation timings of the scan driver 104, the sense driver 106, and the data driver 108. The scan driver 104, the sense driver 106, and the data driver 108 may be implemented with one or more integrated circuits (ICs). The compensation unit of the display apparatus 100 may be implemented with another driver besides the data driver 108.

The voltages ELVDD and ELVSS are supplied to the pixel circuits 112 and the data driver 108. The voltage ELVDD is provided to the pixel circuits 112 and the data driver 108 from the first common power supply source. The voltage ELVDD is selectively provided to a first terminal (e.g., an anode) of the light emitting element of the pixel circuit 112. The voltage ELVSS is provided to the pixel circuits 112 and the data driver 108 from the second common power supply source. The voltage ELVSS is provided to a second terminal (e.g., a cathode) of the light emitting element of the pixel circuit 112.

The first and second common power supply sources may be provided to the display apparatus 100, or may be external power supply sources outside the display apparatus 100. The first and second common power supply sources may be a single power supply circuit (or a power supply device) or different power supply circuits (or power supply devices).

The scan driver 104 is connected to the control lines SCAN(1) to SCAN(n) and selectively provides, to the control lines SCAN(1) to SCAN(n), scan signals that are control signals for light emission control. The scan signals serve to control transistors disposed in the pixel circuits 112.

The sense driver 106 is connected to the control lines SENSE(1) to SENSE(n) and selectively provides, to the control lines SENSE(1) to SENSE(n), sensing signals that are control signals for the sensing operation. The sensing signals serve to control the transistors disposed in the pixel circuits 112.

The data driver 108 is connected to the data lines DT(1) to DT(m) and selectively provides data signals VDATA to the data lines DT(1) to DT(m). Furthermore, the data driver 108 provides the sensing voltages VSENSE to the data lines DT(1) to DT(m). An operation for providing the data signals VDATA or sensing voltages VSENSE to the data lines DT(1) to DT(m) is controlled by a signal SENSE_CNT provided to the data driver 108 from the sense driver 106.

The data driver 108 includes a data memory 114, a plurality of data driver circuits 116 corresponding to the data lines DT(1) to DT(m), and a plurality of sensing circuits 118 corresponding to the data lines DT(1) to DT(m).

The data memory 114 stores data such as the display data. The data memory 114 may include a random access memory (RAM).

Each data driver circuit 116 provides the data signal VDATA to a corresponding data line among the data lines DT(1) to DT(m). The data signal VDATA may be a data signal of gradation data corresponding to non-compensated display data stored in the data memory 114 or may be a data signal of gradation data corresponding to compensated display data.

The sensing circuits 118 sense the VI characteristics of the light emitting elements of the pixel circuits 112 by virtue of current sensing, when the sensing voltages VSENSE are provided to the data lines DT(1) to DT(m). A specific configuration of the sensing circuit 118 will be described in detail below.

The data driver 108 includes a plurality of switches SW1 corresponding to the data driver circuits 116 and a plurality of switches SW2 corresponding to the sensing circuits 118. The switches SW1 and SW2 are turned on or off by the signal SENSE_CNT provided from the sense driver 106.

The switches SW1 and SW2 may be any switching elements such as metal-oxide semiconductor field-effect transistors (MOSFETs).

Referring to FIG. 5, the pixel circuit 112 includes a switch transistor M1, a sampling switch transistor M2, a sensing switch transistor M3, a capacitive element CST, and a light emitting element D.

In an example embodiment, the transistors M1 to M3 of the pixel circuit 112 may be field-effect transistors (FETs) such as thin film transistors (TFTs). FIG. 5 illustrates that the transistors M1 to M3 are P-channel-type TFTs, but the transistors M1 to M3 may be N-channel-type TFTs. Furthermore, the transistors M1 to M3 are not limited to TFTs, and may be other types of transistors.

The switch transistor M1 serves to supply a voltage to an anode of the light emitting element D according to a signal corresponding to the display data. The switch transistor M1 includes a first terminal connected to the anode of the light emitting element D, a second terminal connected to a first power supply source, and a gate (a control terminal).

The switch transistor M1 connects the first power supply source to the first terminal (anode) of the light emitting element D in response to a voltage applied to the gate of the switch transistor M1 through the data line DT(m). Thus, the light emitting element D may be selectively allowed to emit light by the switch transistor M1.

The sampling switch transistor M2 serves to sample, to the gate of the switch transistor M1, ON and OFF voltages according to a data signal received from the data line DT. A gate of the sampling switch transistor M2 is connected to the control line SCAN. The sampling switch transistor M2 selectively applies, to the gate of the switch transistor M1, the ON and OFF voltages according to the data signal in response to the scan signal received from the control line SCAN.

The capacitive element CST maintains a potential of the gate of the switch transistor M1. As the capacitive element CST is provided, the pixel circuit 112 may maintain the display data corresponding to the data signal received from the data line DT. The capacitive element CST may be a capacitor having a certain capacitance. The capacitive element CST may be a parasitic capacitance.

The sensing switch transistor M3 may serve to selectively sense the VI characteristics of the light emitting element D. The sensing switch transistor M3 includes a first terminal connected to the anode of the light emitting element D, a second terminal connected to the data line DT, and a gate (a control terminal. The sensing switch transistor M3 connects the data line DT connected to the second terminal of the sensing switch transistor M3 to the anode of the light emitting element D connected to the first terminal of the sensing switch transistor M3, so that the light emitting element D is selectively sensed.

The gate of the sensing switch transistor M3 is connected to the control line SENSE. The sensing switch transistor M3 selectively connects the data line DT to the anode of the light emitting element D in response to the sensing signal received from the control line SENSE.

The pixel circuit 112 is controlled by the control signals (scan signals, sensing signals) generated by the scan driver 104 and the sense driver 106. The data signal corresponding to the display data is provided to the pixel circuit 112 from the data driver 108. The VI characteristics of the light emitting element D of the pixel circuit 112 are sensed by the sensing circuit 118 of the data driver 108.

The configuration of the pixel circuit 112 may be varied. For example, the pixel circuit 112 may be configured with a suitable circuit for controlling light emission of the light emitting element D according to the display data corresponding to the data signal and for performing sensing on the light emitting element D.

Figure 6:
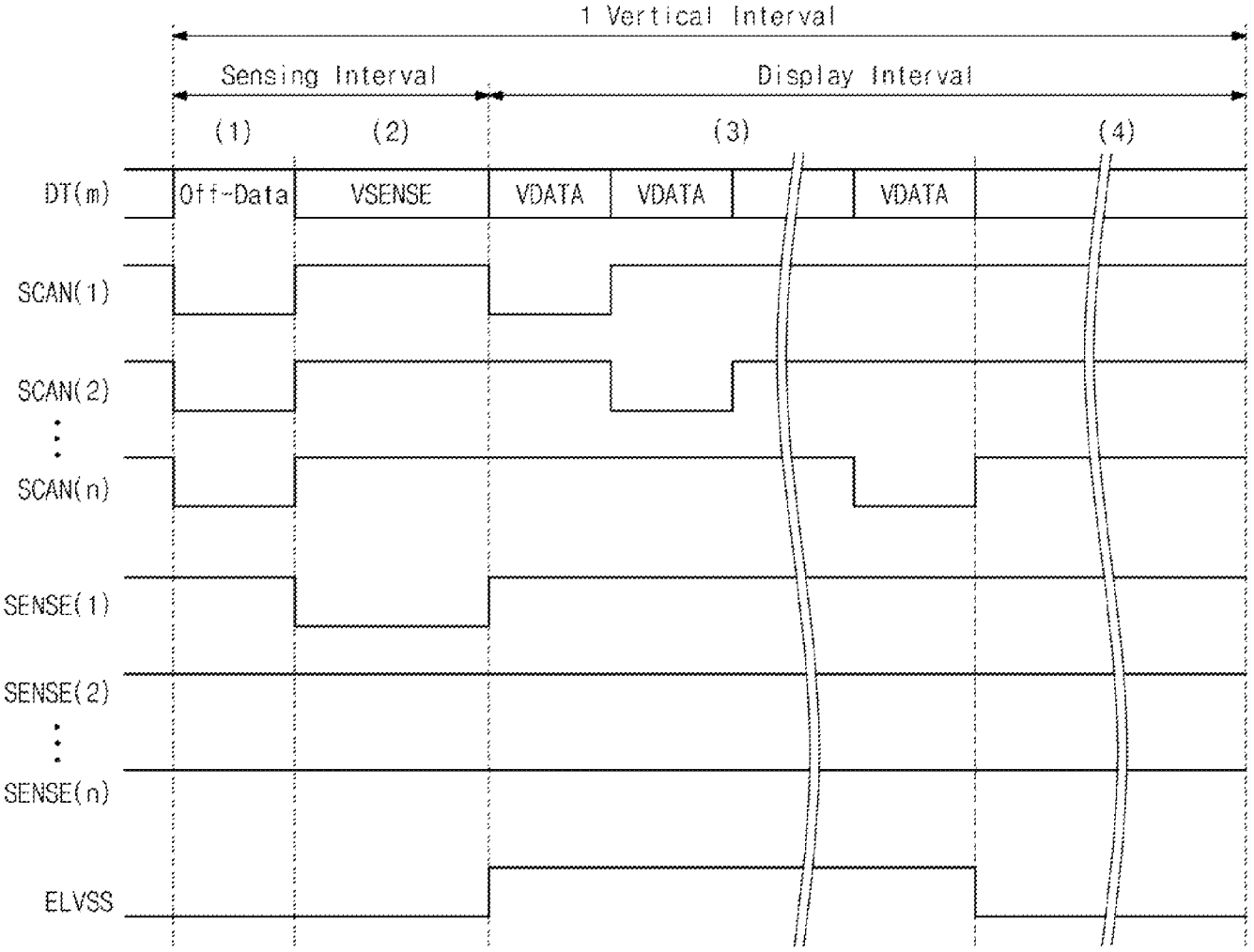
FIG. 6 is a timing diagram exemplarily illustrating operation of the display apparatus according to the first example embodiment at one vertical interval.

FIG. 6 is a timing diagram exemplarily illustrating the operation of the display apparatus according to the first example embodiment at one vertical interval. FIGS. 7A to 7D are diagrams exemplarily illustrating basic operation of the pixel circuit according to the first example embodiment.

Figure 7A:
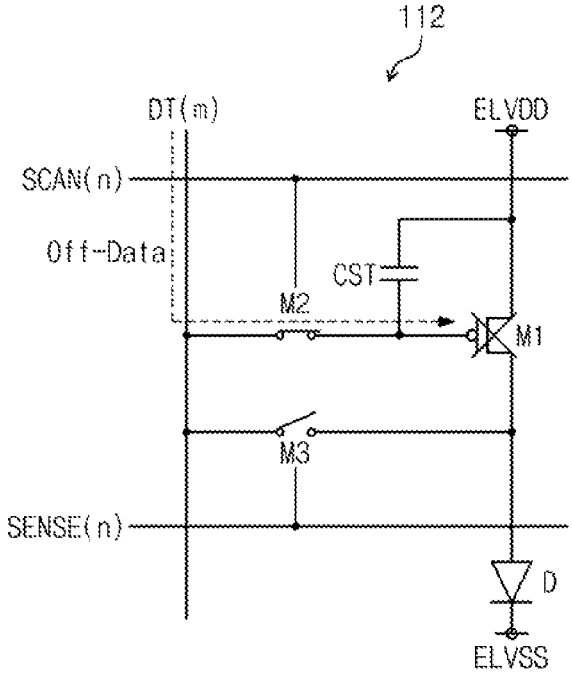
FIGS. 7A to 7D illustrate diagrams exemplarily illustrating basic operation of the pixel circuit according to the first example embodiment.
Figure 7B:
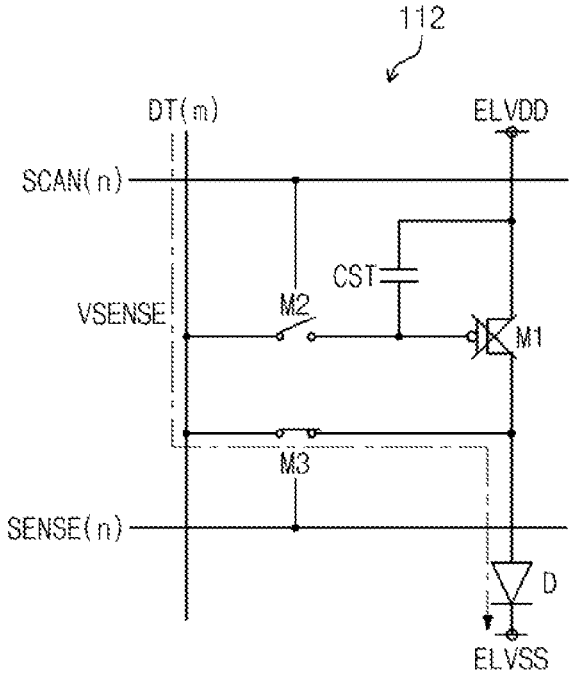
Figure 7C:
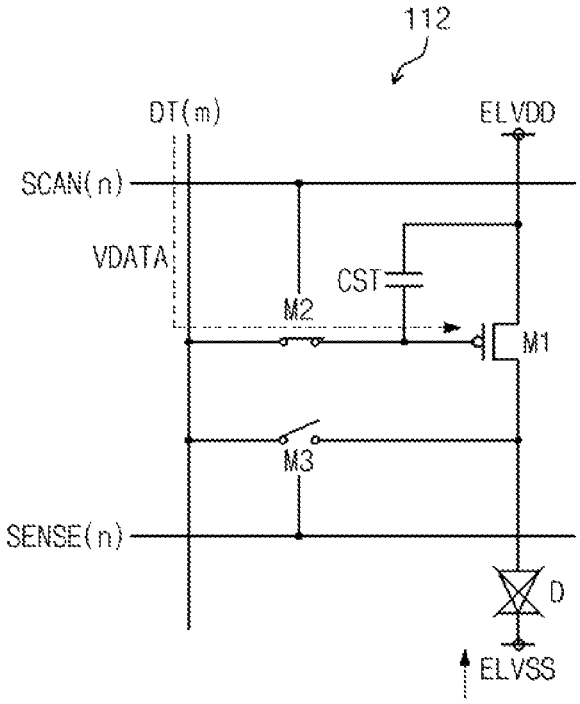
Figure 7D:
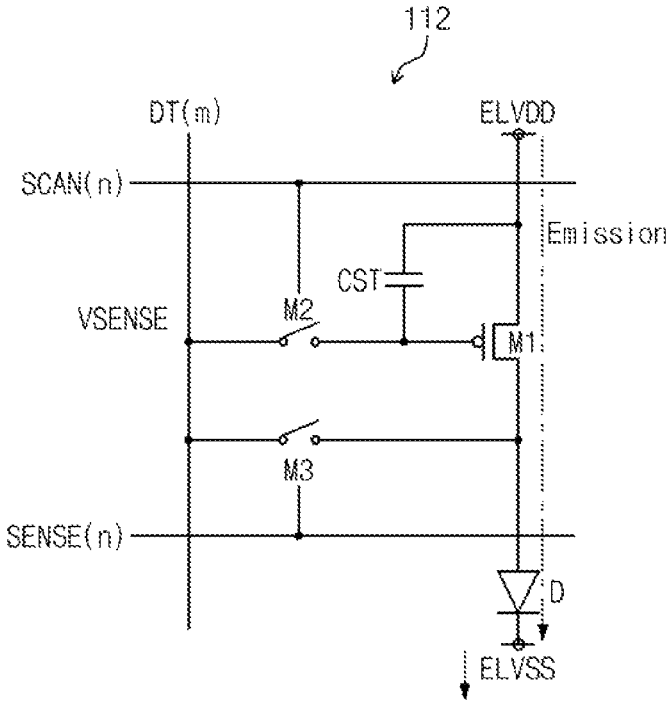

FIG. 7A is a diagram illustrating the operation of the pixel circuit 112 at an interval (1) of FIG. 6. FIG. 7B is a diagram illustrating the operation of the pixel circuit 112 at an interval (2) of FIG. 6. FIG. 7C is a diagram illustrating the operation of the pixel circuit 112 at an interval (3) of FIG. 6. FIG. 7D is a diagram illustrating the operation of the pixel circuit 112 at an interval (4) of FIG. 6.

Referring to FIGS. 6 and 7A to 7D, the operation of the display apparatus 100 is controlled in order of the intervals 1 to 4 illustrated in FIG. 6 at one vertical interval according to the operation of the display apparatus 100.

In the first example embodiment, the intervals (1) to (4) may be defined as below:

(1) Sensing interval: a light emission suspension program interval of a light emitting element, (2) Sensing interval: a characteristic sensing interval for sensing the characteristics of a light emitting element, (3) Display interval: an interval for programming the pixel circuit 112 with data, and (4) Display interval: a light emission interval of a light emitting element.

At the light emission suspension program interval (1) of the sensing interval, the display apparatus 100 programs all the pixel circuits 112 with the off-data so as to cut off the voltage ELVDD from the pixel circuits 112, as illustrated in FIG. 7A.

At the characteristic sensing interval (2) of the sensing interval, the sensing voltage VSENSE is applied to the light emitting element D of the target pixel circuit through the signal line DT so that the light emitting element D is sensed, as illustrated in FIG. 7B.

At the data program interval (3) of the display interval, the pixel circuit 112 is programmed with the data signal VDATA as illustrated in FIG. 7C. During the data program interval, in order to prevent abnormal light emission of the light emitting element D of each pixel circuit 112, the display apparatus 100 changes the voltage ELVSS to a high voltage (high level) so as to suspend light emission of all the pixel circuits 112.

After data programming for all the pixel circuits 112 is completed, at the light emission interval (4) of the display interval, the display apparatus 100 changes the voltage ELVSS to a low voltage (low level) so that the light emitting elements D of all the pixel circuits 112 emit light as illustrated in FIG. 7D.

At each vertical interval, the operation of the display apparatus 100 is controlled in order of the interval (1) to the interval (4). Thus, the display apparatus 100 may control the sensing and the display operation of the light emitting element highly accurately.

Figure 8A:
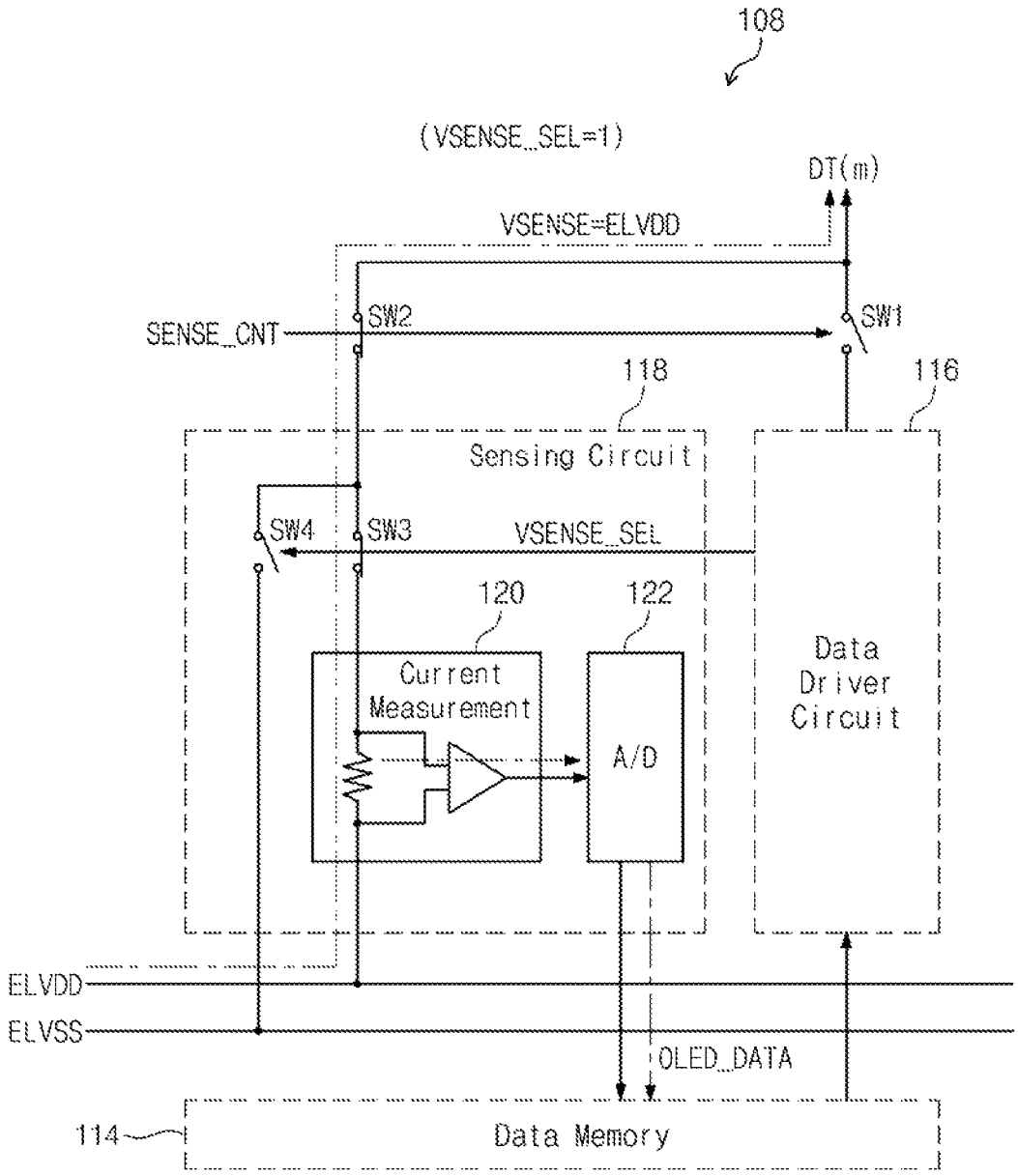
FIGS. 8A and 8B illustrate diagrams illustrating a configuration of the sensing circuit illustrated in FIG. 4.
Figure 8B:
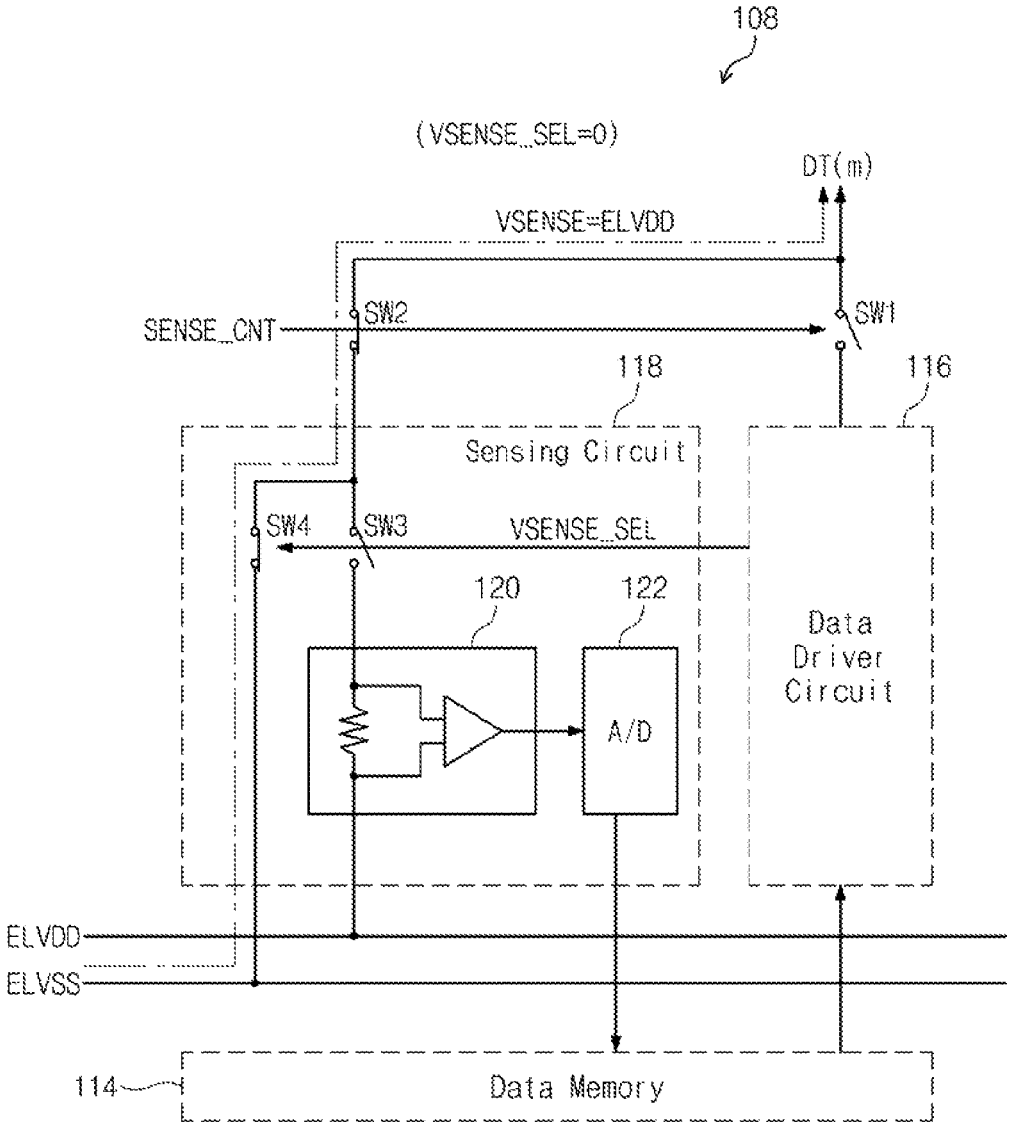
Figure 9:
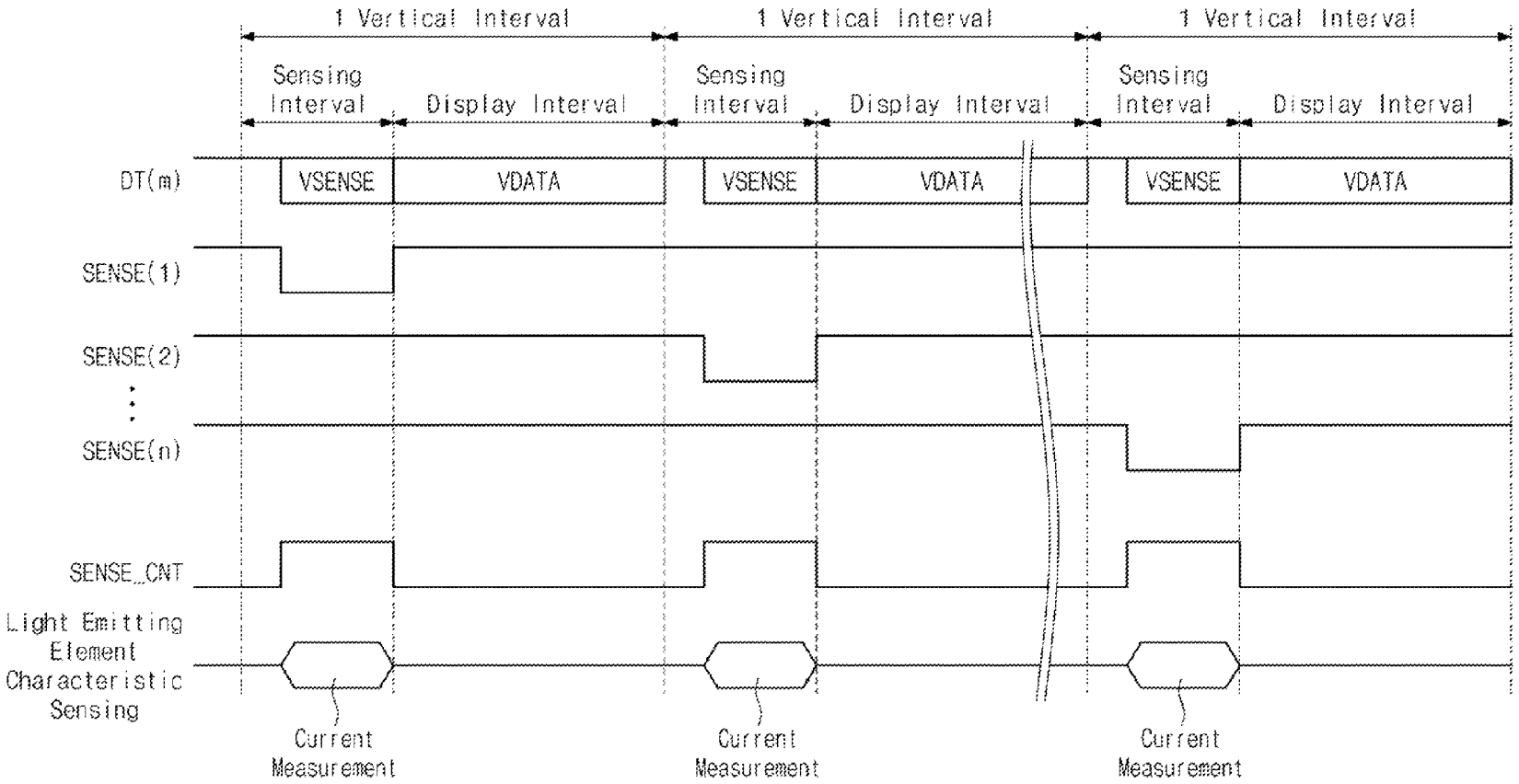
FIG. 9 is a diagram exemplarily illustrating a sensing operation according to an example embodiment.

FIGS. 8A and 8B are diagrams illustrating a configuration of the sensing circuit 118 illustrated in FIG. 4. FIG. 9 is a diagram exemplarily illustrating the sensing operation according to an example embodiment.

FIG. 8A is a diagram illustrating operation of the sensing circuit 118 for sensing the target circuit pixel in the case where the display light emission amount is equal to or larger than the sensing light emission amount. FIG. 8B is a diagram illustrating the operation of the sensing circuit 118 that does not perform the sensing operation on the target pixel circuit in the case where the display light emission amount is smaller than the sensing light emission amount.

Referring to FIGS. 8A, 8B and 9, the sensing circuit 118 includes a switch SW3, a switch SW4, a current measuring circuit 120, and an A/D conversion circuit 122.

The switches SW3 and SW4 are turned on or off in response to a selection signal VSENSE_SEL received from the data driver circuit 116. The switches SW3 and SW4 select the sensing voltage VSENSE of the high voltage ELVDD or the sensing voltage of the low voltage ELVSS in response to the selection signal VSENSE_SEL.

The switches SW3 and SW4 may be any switching elements such as metal-oxide semiconductor field-effect transistors (MOSFETs).

The current measuring circuit 120 measures a current that flows through the data line DT when the characteristics of the light emitting element D of the pixel circuit 112 are measured. The A/D conversion circuit 122 converts a current value measured by the current measuring circuit 120 into a digital signal.

During the sensing interval, if the switch SW2 of the data driver 108 is turned on by the signal SENSE_CNT received from the sense driver 106, the sensing voltage VSENSE is supplied to the pixel circuit 112 from the sensing circuit 118 through the signal line DT.

The sensing voltage VSENSE is set to be the high-level voltage ELVDD (sensing performance) or the low-level voltage ELVSS (sensing suspension) by the switch SW3 or SW4 that is turned on in response to the selection signal VSENSE_SEL, so as to be applied to the data line DT.

For example, the determination of operation S100 of FIG. 1 is performed, and the selection signal VSENSE_SEL having a signal level according to a result of the determination is transferred to the switches SW3 and SW4. Hereinafter, it is assumed that the switch SW3 is turned on and the sensing operation is performed when the selection signal VSENSE_SEL has a high level (i.e., VSENSE_SEL=1). Furthermore, it is assumed that the switch SW4 is turned on and the sensing operation is suspended when the selection signal VSENSE_SEL has a low level (i.e., VSENSE_SEL=0).

In the case where the sensing operation is performed (i.e., VSENSE_SEL=1), the switch SW3 is turned on. As illustrated in FIG. 8A, the sensing circuit 118 provides the voltage ELVDD as the sensing voltage VSENSE to the pixel circuit 112 through the data line DT. Here, since a current is measured by the current measuring circuit 120, the characteristics of the light emitting element D of the pixel circuit 112 are sensed. The target pixel circuit to be sensed, among the pixel circuits 112 of the display unit 102, is controlled by the sensing voltage VSENSE supplied through the control line SENSE.

The current value that indicates the characteristics of the light emitting element D sensed by the current measuring circuit 120 is converted to a digital value by the A/D conversion circuit 122, and data that indicates the digital value is transferred to the memory 114.

In the case where the sensing operation is suspended (i.e., VSENSE_SEL=0), the switch SW4 is turned on. As illustrated in FIG. 8B, the sensing circuit 118 provides the voltage ELVSS as the sensing voltage VSENSE to the pixel circuit 112 through the data line DT. The light emitting element D of the target pixel circuit supplied with the voltage ELVSS does not emit light, and the current measuring circuit 120 does not measure a current.

Therefore, the display apparatus 100 may switch between performance of the operation for sensing the characteristics of the light emitting element D of the target pixel circuit and suspension of the sensing operation.

Figure 10:
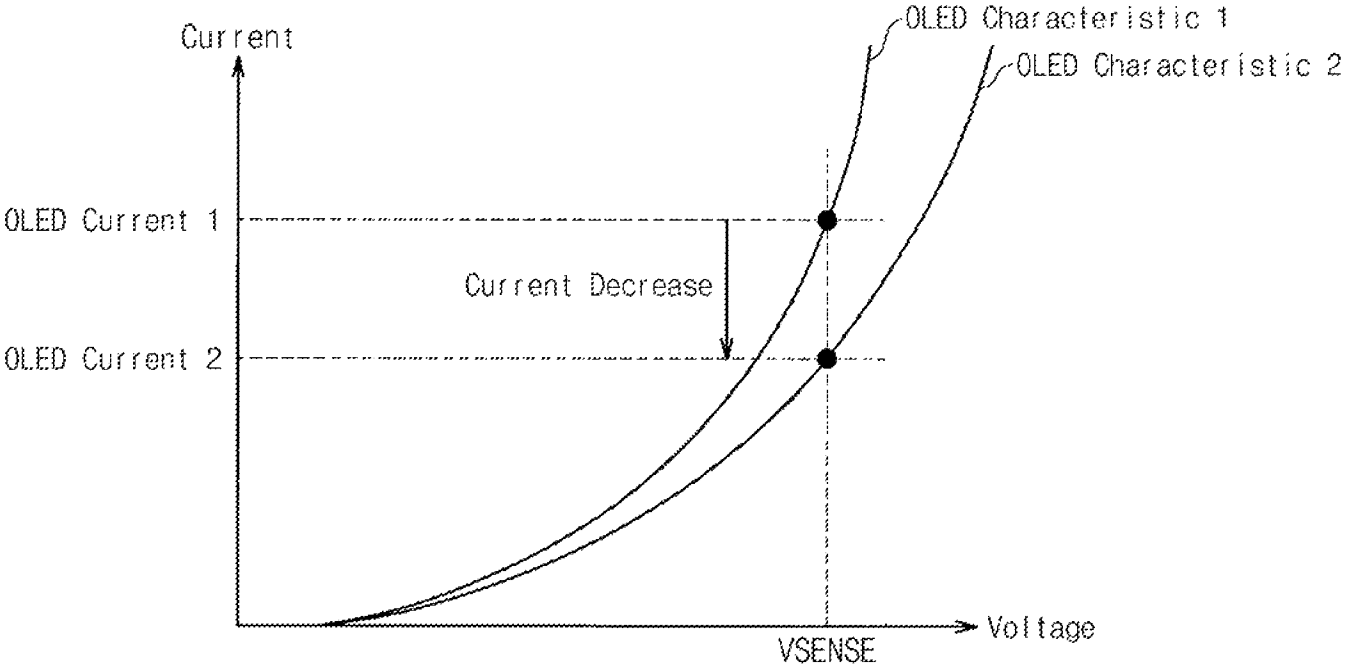
FIG. 10 is a graph illustrating VI characteristics of a light emitting element of a pixel circuit.
Figure 11:
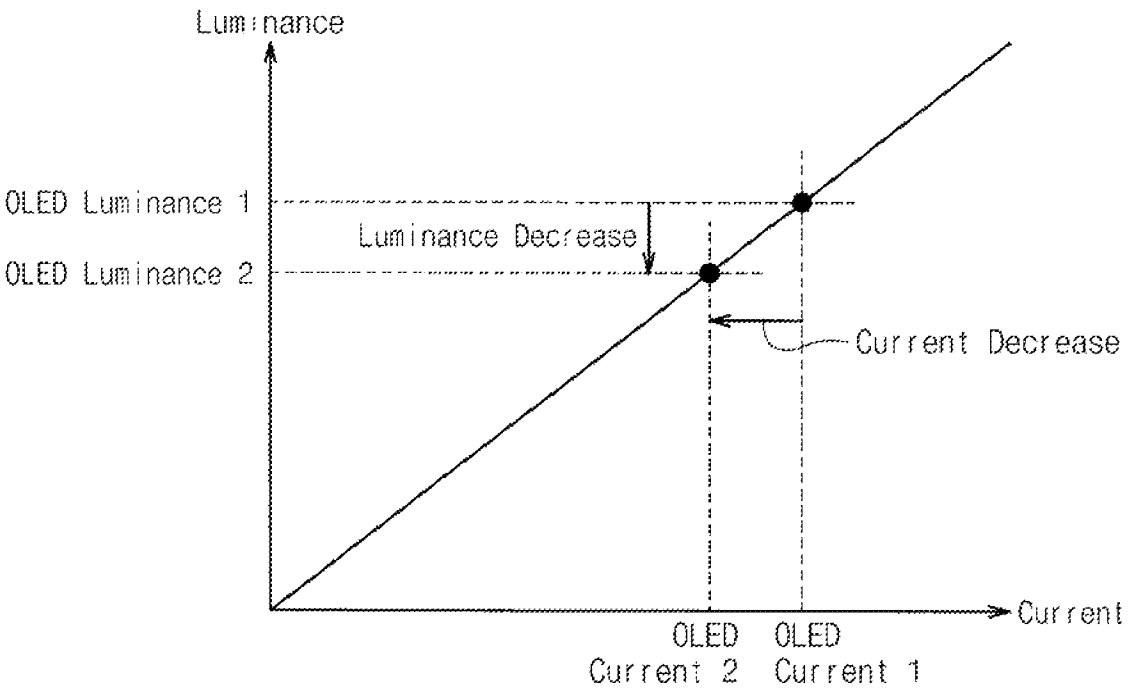
FIG. 11 is a graph illustrating a relation between a luminance and a current that flows to the light emitting element of the pixel circuit.
Figure 12:
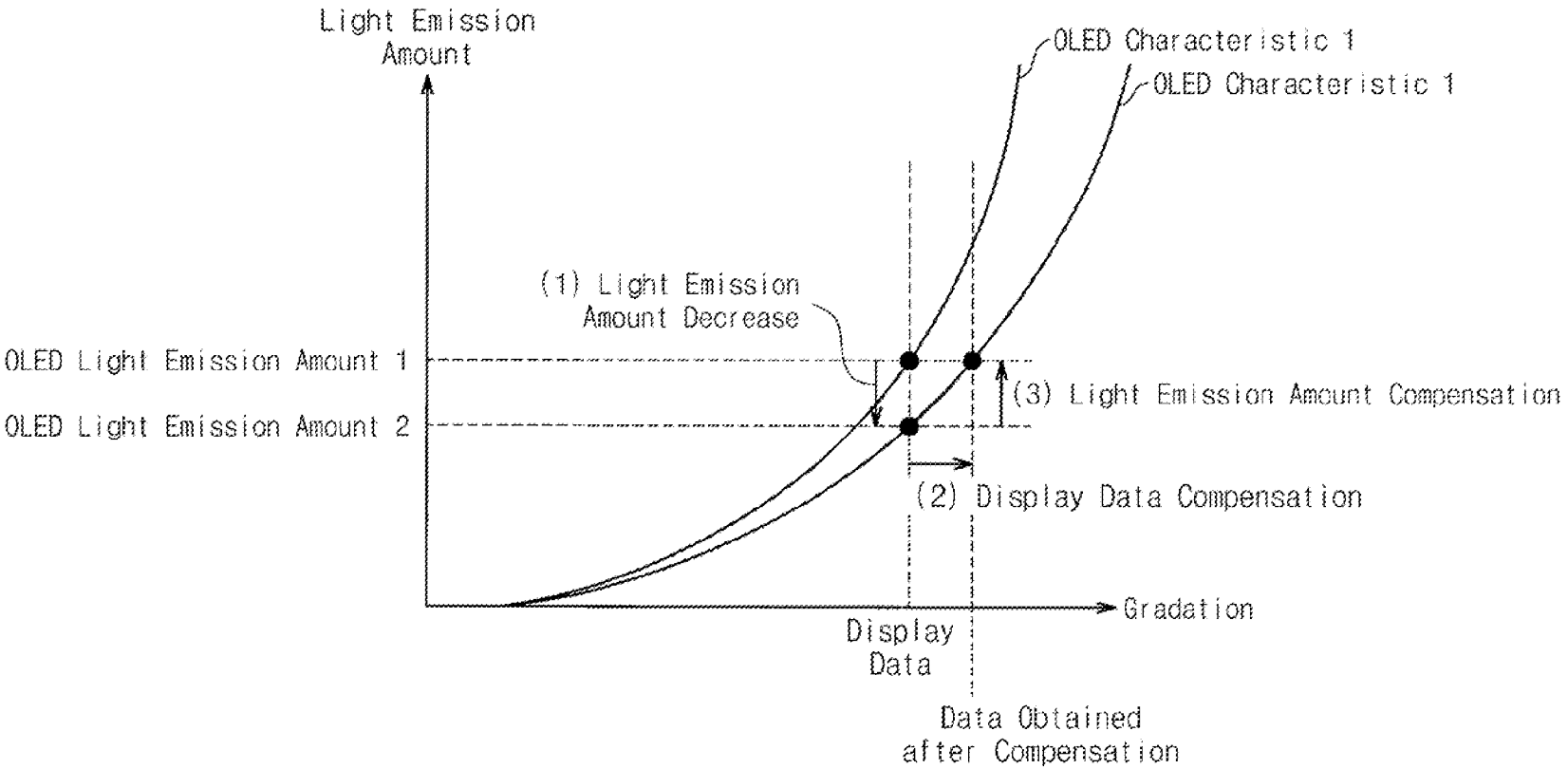
FIG. 12 is a graph illustrating a relation between a gradation and a light emitting amount in the light emitting element of the pixel circuit.

FIG. 10 is a graph illustrating the VI characteristics of the light emitting element of the pixel circuit. FIG. 11 is a graph illustrating a relation between a luminance and a current that flows to the light emitting element of the pixel circuit. FIG. 12 is a graph illustrating a relation between a gradation and a light emission amount in the light emitting element of the pixel circuit.

Referring to FIGS. 10 to 12, light emitting amount (gradation)=luminance×light emission time, in the display apparatus that presents a gradation according to the light emission amount. Therefore, the value of the current that flows to the light emitting element may vary due to a change in the characteristics of the light emitting element and/or the degradation of the characteristics of the light emitting element. For example, in the case where the characteristic of the light emitting element is changed from OLED characteristic 1 to OLED characteristic 2 as illustrated in FIG. 10, the value of the current that flows to the light emitting element is changed from OLED current 1 to OLED current 2.

Furthermore, the luminance is changed due to the change in the value of the current that flows to the light emitting element, and the degradation of the image quality occurs due to the change in the luminance. For example, in the case where the value of the current that flows to the light emitting element is changed from OLED current 1 to OLED current 2 as illustrated in FIG. 10, the luminance is changed from OLED luminance 1 to OLED luminance 2.

As illustrated in FIG. 12, the display apparatus 100 according to an example embodiment senses the characteristics of the light emitting element and compensates the display data (for example, the display data is compensated to be the data after compensation as illustrated in FIG. 12), so that the light emission amount (gradation) becomes the same as before the change thereof. Furthermore, the display apparatus 100 according to an example embodiment compensates the display data on the basis of a result of detecting the VI characteristics of the light emitting element D so as to control the light emission amount (gradation) of each pixel circuit 112.

Since the display apparatus 100 according to the first example embodiment compensates the display data with the light emission amount obtained by subtracting the sensing light emission amount from the display light emission amount, the display data may be matched to the light emission amount of one vertical interval when the sensing operation is performed. Therefore, the display apparatus 100 may prevent the degradation of the image quality due to a line defect which may occur since the light emitting element emits light when the sensing operation is performed and the degradation of the image quality which may occur when the VI characteristics of the light emitting element are sensed.

As described above with reference to FIGS. 8 and 9, the display apparatus 100 may switch between performing the sensing operation on the light emitting element of the target pixel circuit and suspending the sensing operation on the basis of the display data. Therefore, the display apparatus 100 may prevent the degradation of the image quality due to the misadjusted black level even if the display data is for presenting a low degradation.

The display apparatus 100 may compensate for a change in the characteristics of the light emitting element D as described above with reference to FIGS. 10 to 12, and thus may compensate for the change in the characteristics of the light emitting element D without causing the degradation of the image quality.

Hereinafter, a display apparatus for performing analog driving according to a second example embodiment will be described. The display apparatus according to the second example embodiment performs progressive driving for line-sequentially controlling data programming and light emission.

Hereinafter, the display apparatus according to the second example embodiment will be described with a focus on a difference between the display apparatus according to the second example embodiment and the display apparatus according to the first example embodiment, and the same configuration therebetween will not be described.

Figure 13A:
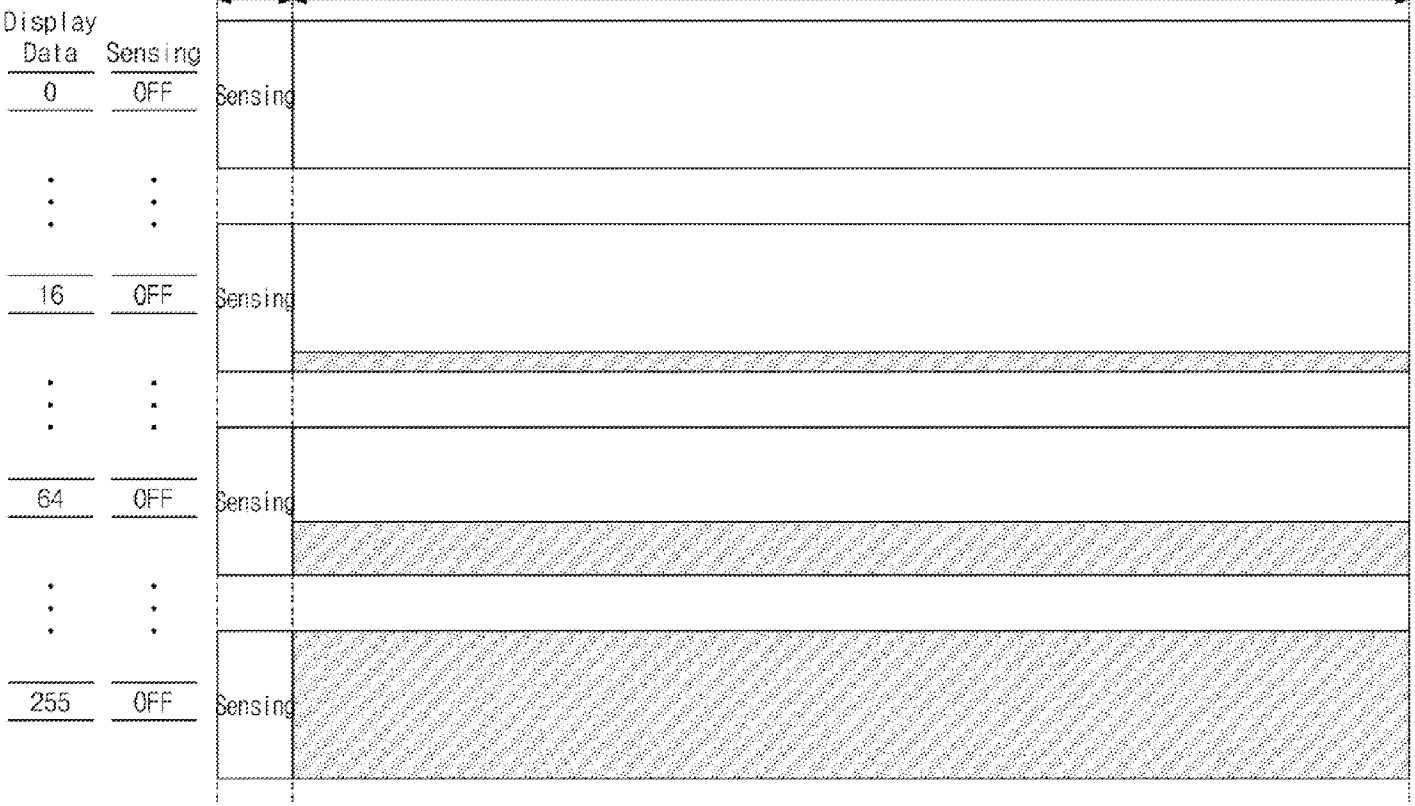
FIGS. 13A and 13B illustrate diagrams exemplarily illustrating display data and a light emission state of the light emitting element of the pixel circuit in a display apparatus according to the second example embodiment.
Figure 13B:
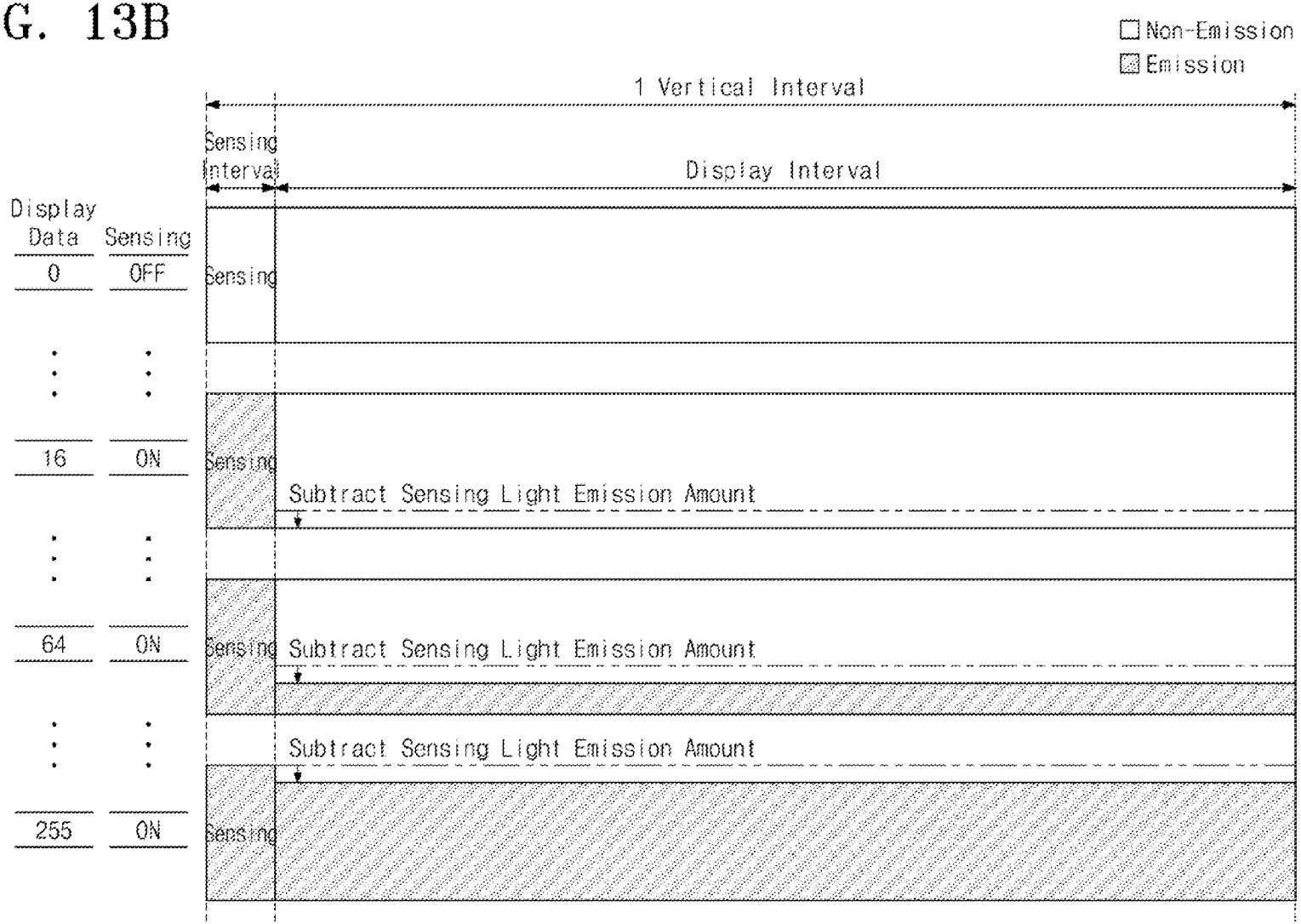

FIGS. 13A and 13B are diagrams exemplarily illustrating the display data and a light emission state of the light emitting element of the pixel circuit in the display apparatus according to the second example embodiment.

FIG. 13A is a diagram exemplarily illustrating the display data and the light emission state of the light emitting element in the non-target pixel circuit, and FIG. 13B is a diagram exemplarily illustrating the display data and the light emission state of the light emitting element in the target pixel circuit. In FIGS. 13A and 13B, the sensing light emission amount is set to be 16 gradations.

Referring to FIGS. 13A and 13B, the display apparatus according to the second example embodiment compensates the display data with the light emission amount obtained by subtracting the sensing light emission amount from the display light emission amount when performing the sensing operation on the target pixel circuit.

In the case where a display gradation=16, for example, the non-target pixel circuit does not emit light at the sensing interval and emits light at the display interval as illustrated in FIG. 13A. Furthermore, as illustrated in FIG. 13B, the target pixel circuit emits light at the sensing interval and does not emit light at the display interval.

Since the light emission amount is determined by the equation of light emission amount=luminance×light emission time, the operations of the non-target pixel circuit of FIG. 13A and the target pixel circuit of FIG. 13B are different from each other with respect to a light emission timing and a luminance, but are the same with respect to a light emission amount at one vertical interval. Thus, it may be understood from FIGS. 13A and 13B that the display data is matched to the light emission amount at one vertical interval.

Figure 14:
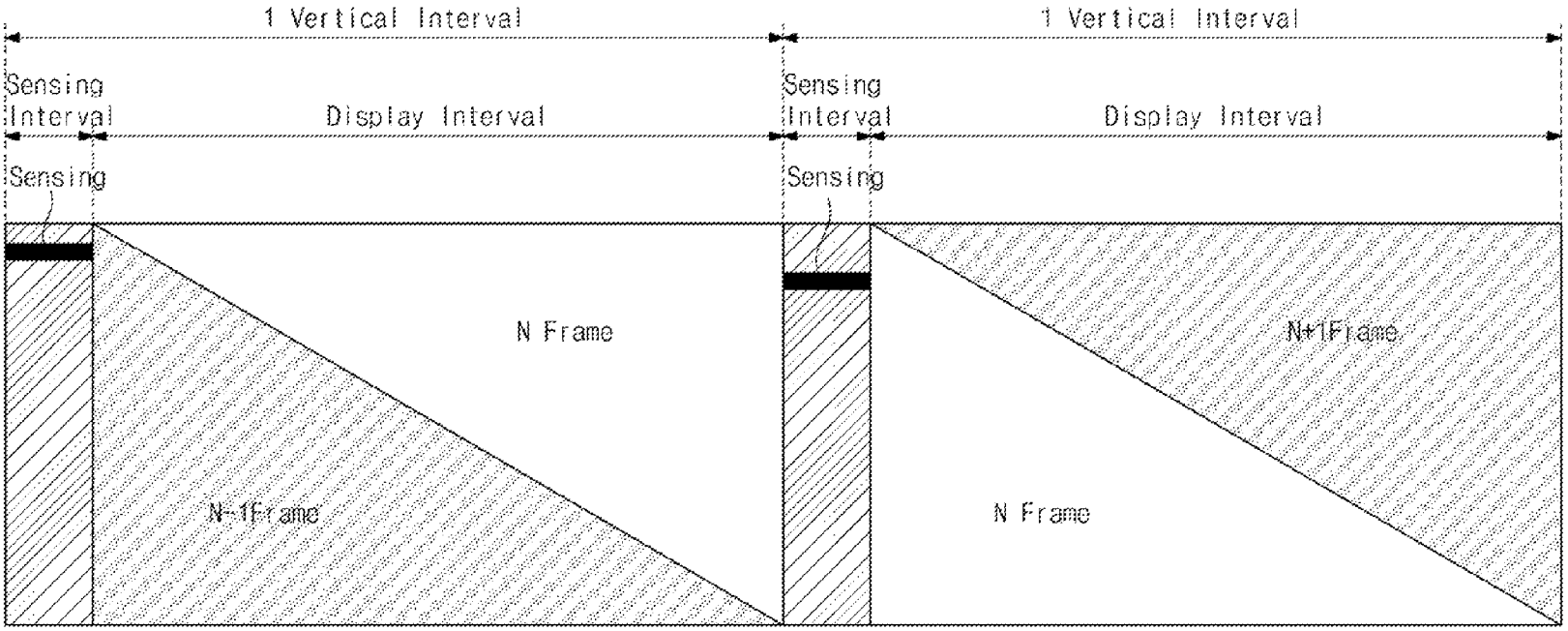
FIG. 14 is a timing chart exemplarily illustrating operation of the display apparatus according to the second example embodiment.

FIG. 14 is a timing chart exemplarily illustrating operation of the display apparatus according to the second example embodiment.

Referring to FIG. 14, the display apparatus according to the second example embodiment performs the progressive driving for line-sequentially controlling data programming and light emission. Regarding the progressive driving, the sub-field weighted for the display data as illustrated in FIG. 3 may not be used, and the light emission suspension program interval may not be used at the sensing interval.

Figure 15:
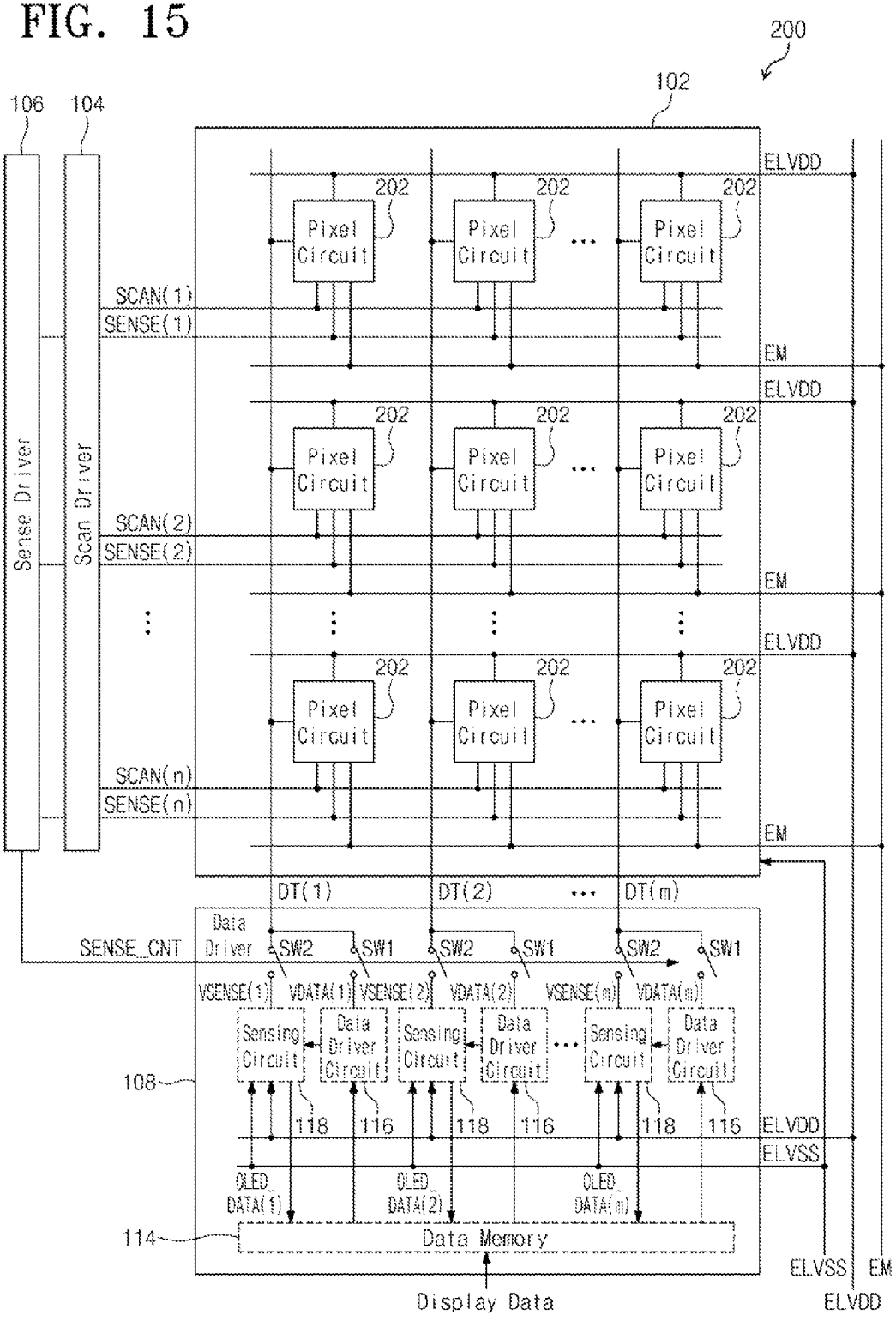
FIG. 15 is a diagram illustrating a configuration of the display apparatus according to the second example embodiment.
Figure 16:
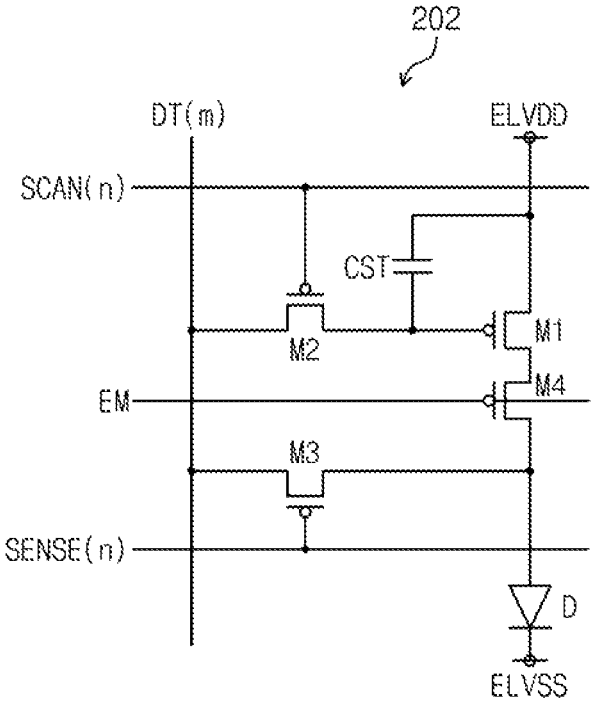
FIG. 16 is a diagram illustrating a configuration of the pixel circuit illustrated in FIG. 15.

FIG. 15 is a diagram illustrating a configuration of the display apparatus according to the second example embodiment. FIG. 16 is a diagram illustrating a configuration of the pixel circuit illustrated in FIG. 15.

Referring to FIG. 15, a display apparatus 200 according to the second example embodiment has basically the same configuration as that of the display apparatus 100 according to the first example embodiment illustrated in FIG. 4. However, compared to the display apparatus 100 according to the first example embodiment, the display apparatus 200 further includes a control line for supplying a light emission control signal EM for controlling suspension of light emission.

Since the display apparatus 200 further includes the control line for supplying the control signal EM, a pixel circuit 202 of the display apparatus 200 has a different configuration from that of the pixel circuit 112 illustrated in FIG. 5.

Referring to FIG. 16, the pixel circuit 202 has basically the same configuration as that of the pixel circuit 112 according to the first example embodiment illustrated in FIG. 5. Compared to the pixel circuit 112 according to the first example embodiment, the pixel circuit 202 further includes an emission switch transistor M4.

The emission switch transistor M4 includes a first terminal connected to an anode of the light emission element D, a second terminal connected to the first terminal of the switch transistor M1, and a gate. The light emission control signal EM is applied to the emission switch transistor M4 through the control line for supplying the light emission control signal EM.

The emission switch transistor M4 of the pixel circuit 202 serves to selectively connects the light emitting element D to the switch transistor M1 on the basis of a voltage level of the light emission control signal EM applied to the gate of the emission switch transistor M4.

The display apparatus 200 provides the light emission control signal EM to the pixel circuit 202 through the signal lines for supplying the light emission control signal EM, so as to control a light emission state and a non-light emission state of the light emitting element D of the pixel circuit 202.

Figure 17:
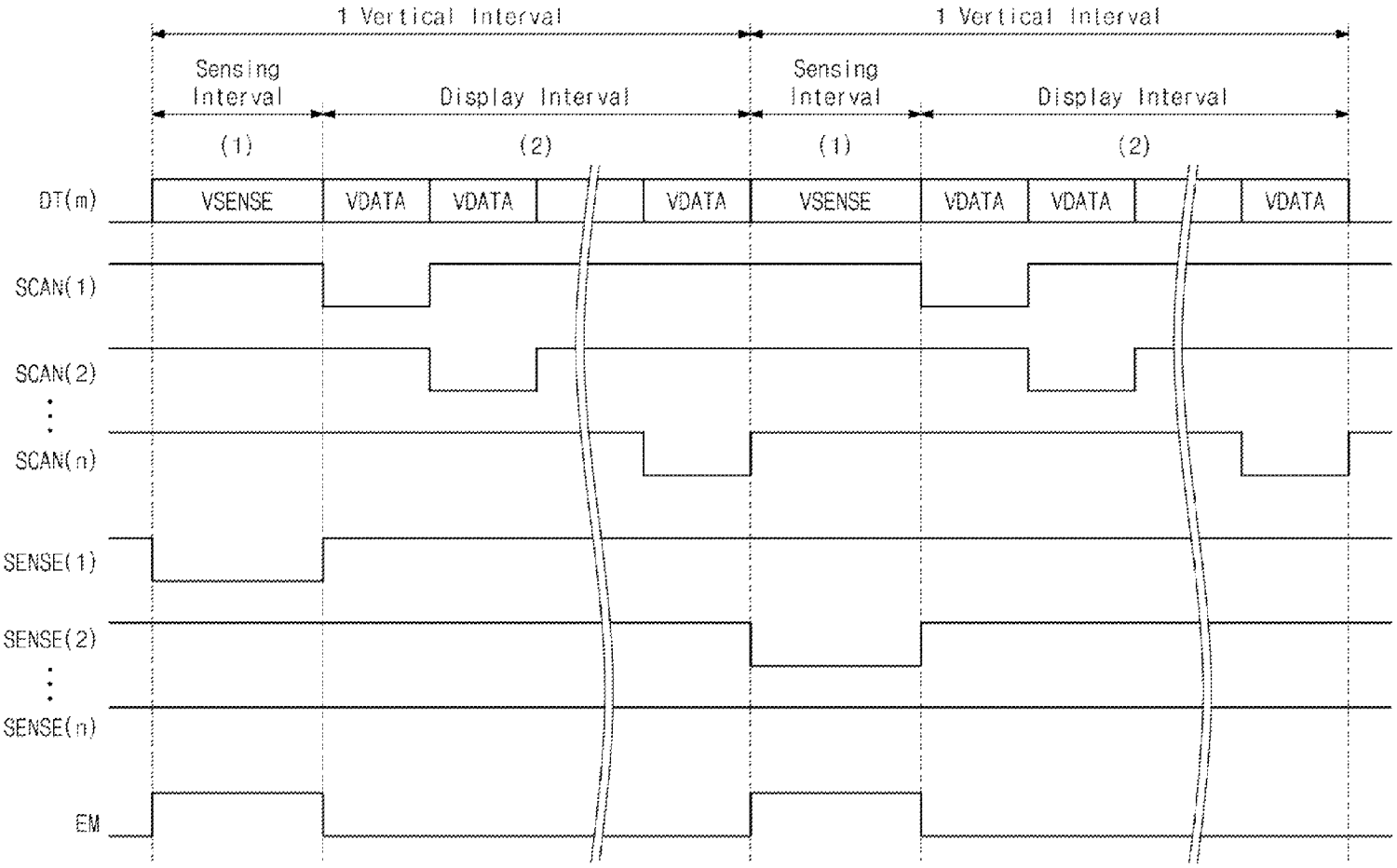
FIG. 17 is a timing diagram exemplarily illustrating operation of the display apparatus according to the second example embodiment at one vertical interval.
Figure 18A:
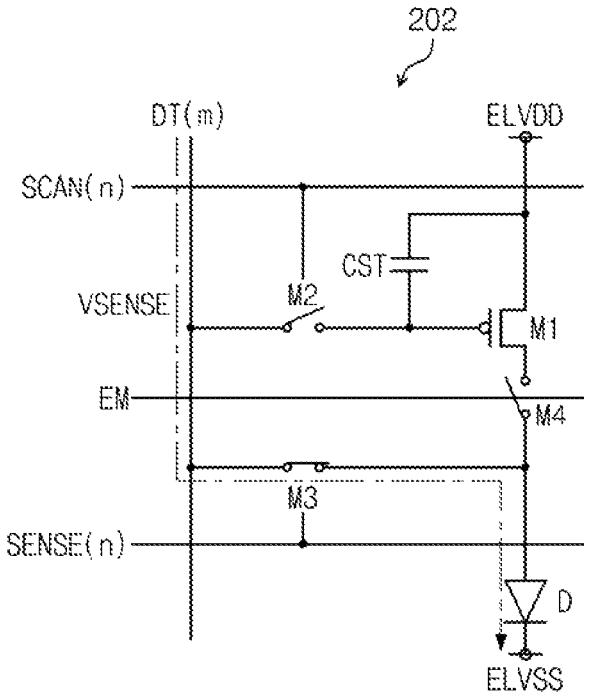
FIGS. 18A to 18C illustrate diagrams exemplarily illustrating basic operation of the pixel circuit according to the second example embodiment.
Figure 18B:
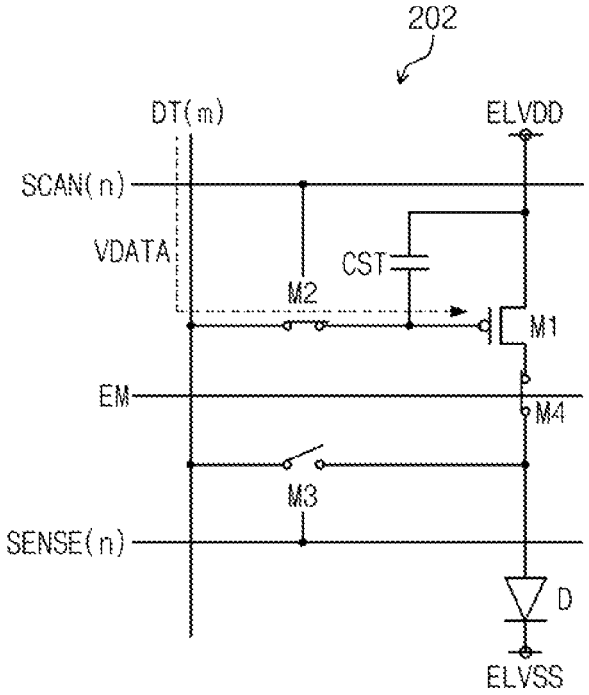
Figure 18C:
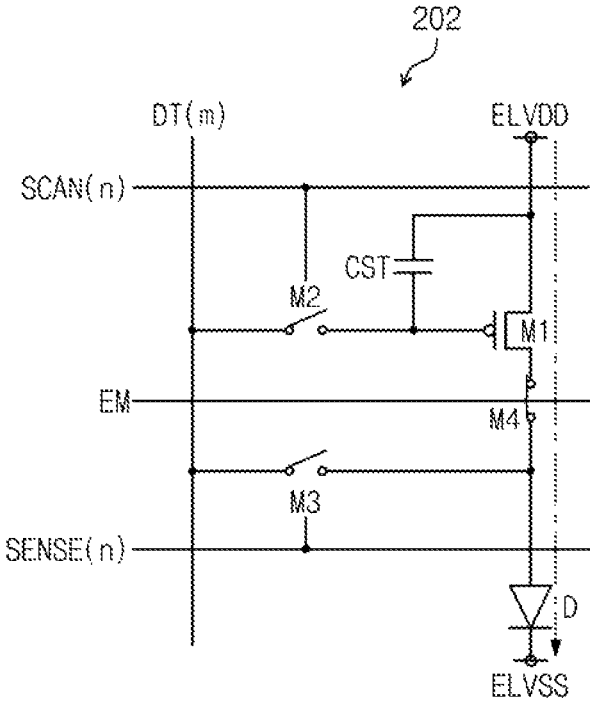

FIG. 17 is a timing diagram exemplarily illustrating operation of the display apparatus according to the second example embodiment at one vertical interval. FIGS. 18A to 18C are diagrams exemplarily illustrating basic operation of the pixel circuit according to the second example embodiment.

FIG. 18A is a diagram illustrating the operation of the pixel circuit 202 at the sensing interval corresponding to an interval (1) of FIG. 17. FIG. 18B is a diagram illustrating the operation of the pixel circuit 202 at a data program interval of an interval (2) of FIG. 17. FIG. 18C is a diagram illustrating the operation of the pixel circuit 202 at a light emission interval of the interval (2) of FIG. 17.

Compared to the display apparatus 100, the display apparatus 200 does not use the light emission suspension program interval at the sensing interval. Furthermore, the display interval includes the data program interval and the light emission interval. In detail, the operation of the display apparatus 200 is controlled in order of the intervals (1) and (2) of FIG. 17 at one vertical interval.

In the second example embodiment, the intervals (1) and (2) may be defined as below:

(1) Sensing interval: a characteristic sensing interval for sensing the characteristics of a light emitting element, and (2) Display interval: an interval for programming the pixel circuit 202 with data and a light emission interval of a light emitting element.

At the sensing interval (1), the display apparatus 200 cuts off the voltage ELVDD from the pixel circuits 202, like the display apparatus 100 according to the first example embodiment. Since the display apparatus 200 controls light emission of the light emitting element of the pixel circuit 202 using the light emission control signal EM, the display apparatus 200 does not use the light emission suspension program interval of the sensing interval of the first example embodiment.

Since pixel circuit 202 is provided with the emission switch transistor M4 between the switch transistor M1 and the light emitting element D, the pixel circuit 202 may maintain the data signal VDATA during the sensing interval. Therefore, the display apparatus 200 may also perform the sensing operation for the progressive driving.

At the data program interval of the display interval (for example, at an interval where the scan signal supplied to the control line SCAN is in a low level at the interval (2) of FIG. 17), the data signal VDATA is written in the capacitive element CST as illustrated in FIG. 18B.

At the light emission interval of the display interval (for example, at an interval where the scan signal supplied to the control line SCAN is in a high level at the interval (2) of FIG. 17), the light emitting element D of the pixel circuit 202 emits light as illustrated in FIG. 18C.

At each vertical interval, the operation of the display apparatus 200 is controlled in order of the interval (1) and the interval (2). Thus, the display apparatus 200 may control the sensing and the display operation of the light emitting element highly accurately.

The display apparatus 200 is not driven in a simultaneous manner but in a progressive manner. The display apparatus 200 compensates the display data with the light emission amount obtained by subtracting the sensing light emission amount from the display light emission amount, like the display apparatus 100 according to the first example embodiment. Therefore, the display apparatus 200 may match the display data to the light emission amount of one vertical interval in the case where the sensing operation is performed.

As a result, the display apparatus 200 may prevent the degradation of the image quality due to a line defect which may occur since the light emitting element emits light when the sensing operation is performed and the degradation of the image quality which may occur when the VI characteristics of the light emitting element are sensed.

Furthermore, like the display apparatus 100 according to the first example embodiment, the display apparatus 200 may switch between performing the sensing operation on the light emitting element of the target pixel circuit and suspending the sensing operation. Therefore, the display apparatus 200 may prevent the degradation of the image quality due to the misadjusted black level even if the display data is for presenting a low degradation.

Furthermore, like the display apparatus 100 according to the first example embodiment, the display apparatus 200 may compensate for a change in the characteristics of the light emitting element D without causing the degradation of the image quality.

As described above, a display apparatus and a method for controlling the same according to embodiments may prevent the degradation of the image quality when the VI characteristics of the light emitting element are sensed. Embodiments may provide a display apparatus that helps prevent degradation of the quality of an image when VI characteristics of a light emitting element are sensed, and a method for controlling the same.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display apparatus, comprising:

a display unit including a plurality of pixel circuits, each of which includes a light emitting element, the display unit displaying an image corresponding to a data signal supplied on a basis of display data, the display unit emitting light during a vertical interval including a display interval and a sensing interval;

a scan driver controlling, for each pixel circuit, light emission of the light emitting element at the display interval, during which the image is displayed;

a sense driver sensing the light emitting element at the sensing interval, during which the light emitting element is sensed using a sensing operation, the sensing interval including an emission interval during which the light emitting element of the target pixel circuit selectively emits light according to the sensing operation; and a data driver compensating the display data when the sensing operation is performed on a target pixel circuit among the plurality of pixel circuits, the data driver compensating the display data by setting a light emission amount of the light emitting element of the target pixel circuit to be an amount obtained by subtracting a sensing light emission amount, which is a light emission amount of the light emitting element of the target pixel circuit during the sensing interval, from a display light emission amount, which is a light emission amount of the light emitting element of the target pixel circuit before the compensation.

2. The display apparatus as claimed in claim 1, wherein:

the display unit emits light during vertical intervals that each include the display interval and the sensing interval, and when the display data of a vertical interval that corresponds to the target pixel circuit is identical to the display data of a vertical interval that corresponds to a non-target pixel circuit among the plurality of pixel circuits, for which the sensing operation is not performed, the data driver compensates the display data so that the light emission amount of the light emitting element of the target pixel circuit is equal to the light emission amount of the light emitting element of the non-target pixel circuit.

3. The display apparatus as claimed in claim 2, wherein the sense driver selectively performs the sensing operation on the target pixel circuit on the basis of the display data.

4. The display apparatus as claimed in claim 3, wherein the sense driver does not perform the sensing operation on the target pixel circuit in a case where the display light emission amount is smaller than the sensing light emission amount, or the display light emission amount is equal to or smaller than the sensing light emission amount.

5. The display apparatus as claimed in claim 1, wherein:

the display interval includes a plurality of sub-fields used in combination to emit light corresponding to the display data, the sensing light emission amount is substantially equal to a light emission amount of a preselected one of the sub-fields, the sense driver performs the sensing operation on the target pixel when the display data for the target pixel has a value that uses the preselected sub-field, and the sense driver does not perform the sensing operation on the target pixel when the display data for the target pixel does not use the preselected sub-field.

6. A method for controlling a display apparatus that includes a display unit including a plurality of pixel circuits, each of which includes a light emitting element, the display unit displaying an image corresponding to a data signal supplied on a basis of display data, the display unit emitting light during a vertical interval including a display interval and a sensing interval, the method comprising:

controlling, for each pixel circuit, light emission of the light emitting element at the display interval, during which the image is displayed, and sensing of the light emitting element at the sensing interval, during which the light emitting element is sensed using a sensing operation, the sensing interval including an emission interval during which the light emitting element of the target pixel circuit selectively emits light according to the sensing operation; and compensating the display data, wherein, when the sensing operation is performed on a target pixel circuit among the plurality of pixel circuits, the compensating of the display data includes setting a light emission amount of the light emitting element of the target pixel circuit to be a light emission amount obtained by subtracting a sensing light emission amount, which is a light emission amount of the light emitting element of the target pixel circuit during the sensing interval, from a display light emission amount, which is a light emission amount of the light emitting element of the target pixel circuit before the compensation.

* * * * *